US011365886B2

(12) United States Patent
Faiella et al.

(10) Patent No.: US 11,365,886 B2
(45) Date of Patent: Jun. 21, 2022

(54) REMOTE MONITORING OF FIRED HEATERS

(71) Applicant: UOP LLC, Des Plaines, IL (US)

(72) Inventors: Theodore Peter Faiella, Evanston, IL (US); Raul A. Ohaco, Glenview, IL (US); Colin J. Deller, Tulsa, OK (US)

(73) Assignee: UOP LLC, Des Plaines, IL (US)

( * ) Notice: Subject to any disclaimer, the term of this patent is extended or adjusted under 35 U.S.C. 154(b) by 722 days.

(21) Appl. No.: 16/011,600

(22) Filed: Jun. 18, 2018

(65) Prior Publication Data

US 2018/0363914 A1 Dec. 20, 2018

Related U.S. Application Data

(60) Provisional application No. 62/521,967, filed on Jun. 19, 2017.

(51) Int. Cl.

| | |
|---|---|
| ***F24B 1/188*** | (2006.01) |
| ***F24B 1/195*** | (2006.01) |
| ***F24B 1/18*** | (2006.01) |
| ***F24C 3/12*** | (2006.01) |
| ***F23N 1/02*** | (2006.01) |
| ***F23D 99/00*** | (2010.01) |

(52) U.S. Cl.

CPC ..... *F24B 1/1886* (2013.01); *F23D 91/04* (2015.07); *F23N 1/022* (2013.01); *F24B 1/1808* (2013.01); *F24B 1/195* (2013.01); *F24C 3/122* (2013.01); *F23N 2223/08* (2020.01); *F23N 2225/00* (2020.01); *F23N 2237/00* (2020.01)

(58) Field of Classification Search

CPC .. F23N 2237/00; F23N 1/022; F23N 2225/00; F23N 2223/08; F23D 91/04; F24C 3/122

See application file for complete search history.

(56) References Cited

U.S. PATENT DOCUMENTS

| | | | | |
|---|---|---|---|---|
| 4,159,239 | A | 6/1979 | Schwartz | 208/113 |
| 4,267,458 | A | 5/1981 | Uram | 290/40 R |
| 4,284,494 | A | 8/1981 | Bartholic | 208/164 |
| 4,362,614 | A | 12/1982 | Asdigian | 208/235 |

(Continued)

FOREIGN PATENT DOCUMENTS

| | | | |
|---|---|---|---|
| CN | 105378384 A | 3/2016 | |
| EP | 0181744 A1 | 5/1986 | B65G 53/66 |

(Continued)

OTHER PUBLICATIONS

Nov. 22, 2018 (PCT/US) International Search Report—App 2018/038264.

(Continued)

*Primary Examiner* — Shogo Sasaki

(57) ABSTRACT

A chemical plant may include one or more fired heaters for heating of process streams. A fired heater may include a direct-fired heat exchanger that uses the hot gases of combustion to raise the temperature of a process fluid feed flowing through tubes positioned within the heater. Fired heaters may deliver feed at a predetermined temperature to the next stage of the reaction process or perform reactions such as thermal cracking. Systems and methods are disclosed to optimize the performance of fired heaters or reduce energy consumption of fired heaters.

7 Claims, 17 Drawing Sheets

(56) References Cited

U.S. PATENT DOCUMENTS 4,380,146 A 4/1983 Yannone ..... 60/39.281
4,385,985 A 5/1983 Gross ..... 208/113
4,411,773 A 10/1983 Gross ..... 208/159
4,709,546 A 12/1987 Weiler ..... 415/116
4,775,460 A 10/1988 Reno
4,795,545 A 1/1989 Schmidt
4,902,469 A 2/1990 Watson ..... 376/216
5,077,252 A 12/1991 Owen et al. ..... 502/43
5,227,121 A 7/1993 Scarola ..... 340/525
5,582,684 A 12/1996 Holmqvist et al. ..... 162/49
5,605,435 A 2/1997 Haugen ..... 137/514
5,616,214 A 4/1997 Leclerc ..... 162/49
5,642,296 A 6/1997 Saxena ..... 216/84
5,666,297 A 9/1997 Britt et al. ..... 364/578
5,817,517 A 10/1998 Perry et al. ..... 436/55
6,038,540 A 3/2000 Krist et al. ..... 705/8
6,081,230 A 6/2000 Hoshino ..... 342/357.32
6,230,486 B1 5/2001 Yasui ..... 123/674
6,266,605 B1 7/2001 Yasui ..... 60/276
6,271,845 B1 8/2001 Richardson ..... 715/764
6,392,114 B1 5/2002 Shields et al. ..... 582/719
6,760,716 B1 7/2004 Ganesamoorthi et al. ..... 706/21
6,772,044 B1 8/2004 Mathur et al. ..... 700/204
6,795,798 B2 9/2004 Eryurek et al. ..... 702/188
6,982,032 B2 * 1/2006 Shaffer ..... B09C 1/10 210/101
6,983,227 B1 1/2006 Thalhammer-Reyero
7,006,889 B2 2/2006 Mathur et al. ..... 700/204
7,067,333 B1 6/2006 Pasadyn et al. ..... 438/5
7,133,807 B2 11/2006 Karasawa ..... 702/188
7,151,966 B1 12/2006 Baier et al. ..... 700/19
7,246,039 B2 7/2007 Moorhouse ..... 702/185
7,313,447 B2 12/2007 Hsuing et al. ..... 700/9
7,415,357 B1 8/2008 Stluka et al. ..... 702/6
7,567,887 B2 7/2009 Emigholz et al. ..... 702/182
7,742,833 B1 6/2010 Herbst et al. ..... 700/108
7,836,941 B2 * 11/2010 Song ..... F28G 7/00 165/95
7,877,596 B2 1/2011 Foo Kune et al. ..... 713/153
7,925,979 B2 4/2011 Forney et al. ..... 715/733
7,936,878 B2 5/2011 Kune et al. ..... 380/270
7,979,192 B2 7/2011 Morrison et al.
7,995,526 B2 8/2011 Liu et al. ..... 370/329
8,050,889 B2 11/2011 Fluegge et al. ..... 702/182
8,055,371 B2 11/2011 Sanford et al. ..... 700/108
8,111,619 B2 2/2012 Liu et al. ..... 370/229
8,128,808 B2 3/2012 Hassan et al. ..... 208/209
8,204,717 B2 6/2012 McLaughlin et al. ..... 702/188
8,244,384 B2 8/2012 Pachner et al. ..... 700/30
8,280,057 B2 10/2012 Budampati et al. ..... 380/270
8,352,049 B2 1/2013 Hsiung et al.
8,354,081 B2 1/2013 Wheat et al.
8,385,436 B2 2/2013 Holm et al. ..... 375/260
8,428,067 B2 4/2013 Budampati et al. ..... 370/395.21
8,458,778 B2 6/2013 Budampati et al. ..... 726/6
8,571,064 B2 10/2013 Kore et al. ..... 370/469
8,630,962 B2 1/2014 Maeda ..... 706/12
8,644,192 B2 2/2014 Budampati et al. ..... 370/255
8,811,231 B2 8/2014 Budampati et al. ..... 370/255
8,815,152 B2 8/2014 Burgess et al.
8,923,882 B2 12/2014 Gandhi et al. ..... 455/455
8,926,737 B2 1/2015 Chatterjee et al.
9,053,260 B2 6/2015 Romatier et al.
9,134,717 B2 9/2015 Trnka
9,166,667 B2 10/2015 Thanikachalam
9,176,498 B2 11/2015 Baramov
9,354,631 B2 5/2016 Mohideen et al.
9,571,919 B2 2/2017 Zhang et al.
9,580,341 B1 2/2017 Brown et al. ..... C02F 3/006
9,751,817 B2 9/2017 Jani et al.
9,864,823 B2 1/2018 Horn et al.
9,968,899 B1 5/2018 Gellaboina et al.
10,095,200 B2 10/2018 Horn et al.
10,107,295 B1 10/2018 Brecheisen
10,180,680 B2 1/2019 Horn et al.
10,183,266 B2 1/2019 Victor et al.
10,222,787 B2 3/2019 Romatier et al.
10,328,408 B2 6/2019 Victor et al.
2002/0123864 A1 9/2002 Eryurek et al. ..... 702/188
2002/0179495 A1 12/2002 Heyse et al. ..... 208/137
2002/0179525 A1 * 12/2002 Shaffer ..... C12M 41/12 210/610
2003/0036052 A1 2/2003 Delwiche et al. ..... 435/4
2003/0105775 A1 6/2003 Shimada
2003/0147351 A1 8/2003 Greenlee ..... 370/232
2003/0223918 A1 12/2003 Cammy ..... 422/144
2004/0079392 A1 4/2004 Kuechler ..... 134/22.19
2004/0099572 A1 5/2004 Evans ..... 208/113
2004/0109788 A1 * 6/2004 Li ..... C02F 1/006 422/3
2004/0122273 A1 6/2004 Kabin ..... 585/639
2004/0122936 A1 6/2004 Mizelle et al.
2004/0147036 A1 7/2004 Krenn et al. ..... 436/119
2004/0148144 A1 7/2004 Martin
2004/0204775 A1 10/2004 Keyes ..... 705/30
2004/0204913 A1 10/2004 Mueller et al.
2004/0220689 A1 11/2004 Mathur et al. ..... 700/97
2004/0220778 A1 11/2004 Imai et al. ..... 702/188
2005/0027721 A1 2/2005 Saenz ..... 707/100
2005/0029163 A1 2/2005 Letzsch ..... 208/113
2005/0133211 A1 6/2005 Osborn et al.
2005/0216209 A1 9/2005 Evans ..... 702/45
2006/0020423 A1 1/2006 Sharpe, Jr. ..... 702/183
2006/0133412 A1 6/2006 Callaghan ..... 370/465
2006/0252642 A1 11/2006 Kanazirev
2006/0259163 A1 11/2006 Hsiung et al. ..... 700/30
2007/0020154 A1 1/2007 Evans ..... 422/139
2007/0059159 A1 3/2007 Hjerpe ..... 415/117
2007/0059838 A1 3/2007 Morrison et al. ..... 436/55
2007/0091824 A1 4/2007 Budampati et al. ..... 370/255
2007/0091825 A1 4/2007 Budampati et al. ..... 370/255
2007/0185664 A1 8/2007 Tanaka ..... 702/56
2007/0192078 A1 8/2007 Nasle et al. ..... 703/14
2007/0212790 A1 9/2007 Welch et al. ..... 436/139
2007/0250292 A1 10/2007 Alagappan et al. ..... 702/184
2007/0260656 A1 11/2007 Wiig
2007/0271452 A1 11/2007 Foo Kune et al. ..... 713/150
2008/0086322 A1 4/2008 Wallace ..... 705/1
2008/0130902 A1 6/2008 Foo Kune et al. ..... 380/286
2008/0154434 A1 6/2008 Galloway et al.
2008/0217005 A1 9/2008 Stluka et al. ..... 166/250.01
2008/0282606 A1 * 11/2008 Plaza ..... C11C 3/003 44/308
2009/0059786 A1 3/2009 Budampati et al. ..... 370/230
2009/0060192 A1 3/2009 Budampati et al. ..... 380/270
2009/0064295 A1 3/2009 Budampati et al. ..... 726/6
2009/0201899 A1 8/2009 Liu et al. ..... 370/338
2009/0204245 A1 8/2009 Sustaeta ..... 700/99
2009/0245286 A1 10/2009 Kore et al. ..... 370/475
2009/0268674 A1 10/2009 Liu et al. ..... 370/329
2009/0281677 A1 11/2009 Botich ..... 700/295
2010/0014599 A1 1/2010 Holm et al. ..... 375/260
2010/0108567 A1 5/2010 Medoff ..... 208/49
2010/0125347 A1 5/2010 Martin et al. ..... 700/31
2010/0152900 A1 6/2010 Gurciullo et al.
2010/0158764 A1 6/2010 Hedrick ..... 422/134
2010/0230324 A1 9/2010 Al-Alloush et al. ..... 208/82
2010/0262900 A1 10/2010 Romatier et al. ..... 715/219
2011/0112659 A1 5/2011 Pachner et al. ..... 700/29
2011/0152590 A1 6/2011 Sadler et al. ..... 585/313
2011/0152591 A1 6/2011 Sadler et al. ..... 585/313
2011/0174597 A1 * 7/2011 Bartek ..... F23G 5/444 198/617
2011/0213488 A1 9/2011 Suzuki et al.
2011/0311014 A1 12/2011 Hottovy et al. ..... 376/283
2012/0029966 A1 2/2012 Cheewakriengkrai et al. ..... 705/7.25
2012/0083933 A1 4/2012 Subbu et al. ..... 700/291
2012/0095808 A1 4/2012 Kattapuram et al. ..... 705/7.37
2012/0104295 A1 5/2012 Do et al. ..... 251/129.01
2012/0121376 A1 5/2012 Huis in Het Veld ..... 415/1
2012/0123583 A1 5/2012 Hazen et al.
2012/0197616 A1 8/2012 Trnka ..... 703/6
2012/0259583 A1 10/2012 Noboa et al.

(56) References Cited

U.S. PATENT DOCUMENTS

2013/0029587 A1 1/2013 Gandhi et al. ..... 455/7
2013/0031960 A1 2/2013 Delrahim ..... 73/40.5 R
2013/0079899 A1 3/2013 Baramov ..... 700/32
2013/0090088 A1* 4/2013 Chevsky ..... H04W 12/06 455/411
2013/0094422 A1 4/2013 Thanikachalam ..... 370/312
2013/0172643 A1 7/2013 Pradeep ..... 585/310
2013/0180175 A1 7/2013 Leininger et al.
2013/0238154 A1 9/2013 Noureldin et al.
2013/0253898 A1 9/2013 Meagher et al. ..... 703/18
2013/0270157 A1 10/2013 Ferrara ..... 208/48 AA
2013/0311437 A1 11/2013 Stluka et al. ..... 707/706
2013/0327052 A1 12/2013 O'Neill ..... 60/772
2014/0008035 A1 1/2014 Patankar et al.
2014/0026598 A1 1/2014 Trawicki ..... 62/56
2014/0074273 A1 3/2014 Mohideen et al. ..... 700/98
2014/0114039 A1 4/2014 Benham et al. ..... 526/348.5
2014/0131027 A1 5/2014 Chir ..... 165/300
2014/0150438 A1 6/2014 Ellis et al.
2014/0163275 A1 6/2014 Yanagawa et al. ..... 585/319
2014/0179968 A1 6/2014 Yanagawa et al. ..... 585/476
2014/0212978 A1 7/2014 Sharpe, Jr. et al. ..... 436/6
2014/0294683 A1 10/2014 Siedler ..... 422/129
2014/0294684 A1 10/2014 Siedler ..... 422/129
2014/0296058 A1 10/2014 Sechrist et al. ..... 502/53
2014/0309756 A1 10/2014 Trygstad ..... 700/31
2014/0337256 A1 11/2014 Varadi et al. ..... 706/12
2014/0337277 A1 11/2014 Asenjo et al.
2015/0059714 A1 3/2015 Bernards ..... 123/568.11
2015/0060331 A1 3/2015 Sechrist et al.
2015/0077263 A1 3/2015 Ali et al. ..... 340/679
2015/0078970 A1 3/2015 Iddir et al. ..... 422/218
2015/0098862 A1 4/2015 Lok et al. ..... 422/49
2015/0158789 A1 6/2015 Keusenkothen
2015/0185716 A1 7/2015 Wichmann et al. ..... 700/287
2015/0276208 A1 10/2015 Maturana et al. ..... 700/274
2015/0284641 A1 10/2015 Shi ..... 208/113
2015/0330571 A1 11/2015 Beuneken ..... 141/4
2016/0033941 A1 2/2016 T et al. ..... 700/81
2016/0048119 A1 2/2016 Wojsznis ..... 700/11
2016/0098037 A1 4/2016 Zornio et al. ..... 700/20
2016/0098234 A1 4/2016 Weaver ..... 358/1.15
2016/0102859 A1 4/2016 Fisher
2016/0122663 A1 5/2016 Pintart et al.
2016/0147204 A1 5/2016 Wichmann et al. ..... 700/287
2016/0184549 A1 6/2016 Bugamelli et al.
2016/0237910 A1 8/2016 Saito
2016/0260041 A1* 9/2016 Horn ..... G06Q 10/06316
2016/0291584 A1 10/2016 Horn et al.
2016/0292188 A1 10/2016 Horn et al.
2016/0292325 A1 10/2016 Horn et al.
2016/0313653 A1 10/2016 Mink
2016/0363315 A1 12/2016 Colannino et al.
2017/0009932 A1 1/2017 Oh
2017/0058213 A1 3/2017 Oprins ..... 585/303
2017/0082320 A1 3/2017 Wang
2017/0107188 A1 4/2017 Kawaguchi
2017/0284410 A1 10/2017 Sharpe, Jr.
2017/0315543 A1 11/2017 Horn et al.
2017/0323038 A1 11/2017 Horn et al.
2017/0352899 A1 12/2017 Asai
2018/0046155 A1 2/2018 Horn et al.
2018/0081344 A1 3/2018 Romatier et al.
2018/0082569 A1 3/2018 Horn et al.
2018/0121581 A1 5/2018 Horn et al.
2018/0122021 A1 5/2018 Horn et al.
2018/0155638 A1 6/2018 Al-Ghamdi ..... 208/79
2018/0155642 A1 6/2018 Al-Ghamdi et al.
2018/0197350 A1 7/2018 Kim
2018/0275690 A1 9/2018 Lattanzio et al.
2018/0275691 A1 9/2018 Lattanzio et al.
2018/0275692 A1 9/2018 Lattanzio et al.
2018/0280914 A1 10/2018 Victor et al.
2018/0280917 A1 10/2018 Victor et al.
2018/0282633 A1 10/2018 Van de Cotte et al.
2018/0282634 A1 10/2018 Van de Cotte et al.
2018/0282635 A1 10/2018 Van de Cotte et al.
2018/0283368 A1 10/2018 Van de Cotte et al.
2018/0283392 A1 10/2018 Van de Cotte et al.
2018/0283404 A1 10/2018 Van de Cotte et al.
2018/0283811 A1 10/2018 Victor et al.
2018/0283812 A1 10/2018 Victor et al.
2018/0283813 A1 10/2018 Victor et al.
2018/0283815 A1 10/2018 Victor et al.
2018/0283816 A1 10/2018 Victor et al.
2018/0283818 A1 10/2018 Victor et al.
2018/0284705 A1 10/2018 Van de Cotte et al.
2018/0286141 A1 10/2018 Van de Cotte et al.
2018/0311609 A1 11/2018 McCool et al.
2018/0362862 A1 12/2018 Gellaboina et al.
2018/0363914 A1 12/2018 Faiella et al.
2018/0364747 A1 12/2018 Charr et al.
2019/0002318 A1 1/2019 Thakkar et al.
2019/0003978 A1 1/2019 Shi et al.
2019/0015806 A1 1/2019 Gellaboina et al.
2019/0041813 A1 2/2019 Horn et al.
2019/0083920 A1 3/2019 Bjorklund et al.
2019/0101336 A1 4/2019 Victor et al.
2019/0101342 A1 4/2019 Victor et al.
2019/0101907 A1 4/2019 Charr et al.
2019/0102966 A1 4/2019 Lorenz
2019/0108454 A1 4/2019 Banerjee et al.
2019/0120810 A1 4/2019 Kumar et al.
2019/0151814 A1 5/2019 Victor et al.
2019/0155259 A1 5/2019 Romatier et al.
2019/0258234 A1* 8/2019 Kaye ..... G05B 23/0289

FOREIGN PATENT DOCUMENTS

EP 0488969 A2 6/1992
EP 2746884 A1 6/2014 ..... G05B 23/02
EP 2801937 A1 11/2014 ..... G06Q 10/06
GB 1134439 A 11/1968 ..... G01N 31/22
WO WO 1990/010083 A1 9/1990 ..... C12Q 1/04
WO WO 2001/060951 A1 8/2001 ..... C10G 51/04
WO 2006044408 A1 4/2006
WO WO 2006/044408 A1 4/2006 ..... F23D 14/72
WO WO 2007/095585 A2 8/2007 ..... A61K 31/721
WO WO 2009/046095 A1 4/2009 ..... G06F 11/00
WO WO 2014/042508 A1 3/2014 ..... G06Q 50/04
WO WO 2014/123993 A1 8/2014 ..... G06F 17/00
WO WO 2016/141128 A1 9/2016 ..... G06Q 10/06
WO WO 2017/079058 A1 5/2017 ..... B01D 1/14

OTHER PUBLICATIONS

Bespalov A. V. et al., Control systems of chemical and technological processes, pp. 508-509 (2001) (Russian).
Daniel Goebel, Dry Gas Seal Contamination During Operation and Pressurization Hold, [online], Feb. 2016, [retrieved on Jun. 19, 2019]. Retrieved from <https ://core.ac.uk/download/pdf/84815277. pdf> (Year: 2016).
EnergyMEDOR®, Product brochure (Nov. 2014).
Chistof Huber, Density and Concentration Measurement Application for Novel MEMS-based Micro Densitometer for Gas, [online], 2016, [retrieved on Jun. 19, 2019], Retrieved from <https://www.ama-science.org/proceedings/getFile/ZwZ1 BD==> (Year: 2016).
Lotters, Real-time Composition Determination of Gas Mixtures, [online], 2015, [retrieved on Jun. 19, 2019], Retrieved from <https://www .ama-science.org/proceedings/getFile/ZwNOZj==> (Year: 2015).
Maybeck, Peter S., "Stochastic models, estimation, and control," vol. 1, Academic Press (1979), 19 pages.

* cited by examiner

REMOTE MONITORING OF FIRED HEATERS

This application claims the benefit of priority under 35 U.S.C. § 119(e) to U.S. Provisional Application No. 62/521,967, filed Jun. 19, 2017, which is incorporated by reference.

FIELD

The disclosure relates generally to a method and system for managing the operation of a plant, such as a chemical plant or a petrochemical plant or a refinery, and more particularly to a method for improving the performance of components that make up operations in a plant.

BACKGROUND

A plant or refinery may include fired heaters for heating process streams. Fired heaters may be subject to various problems. Equipment may break down over time, and need to be repaired or replaced. Additionally, a process may be more or less efficient depending on one or more operating characteristics. There will always be a need for improving process efficiencies and improving equipment reliability.

SUMMARY

The following summary presents a simplified summary of certain features. The summary is not an extensive overview and is not intended to identify key or critical elements.

One or more embodiments may include a system including a plant that includes a fired heater unit, one or more sensors configured to measure operating information for the fired heater unit of the plant, a data collection platform, a data analysis platform, and/or a control platform. The data collection platform may include one or more processors of the data collection platform; a communication interface of the data collection platform and in communication with the one or more sensors; and non-transitory computer-readable memory storing executable instructions that, when executed, cause the data collection platform to: receive sensor data comprising the operating information for the fired heater unit of the plant; correlate the sensor data with time data; and transmit the sensor data. The data analysis platform may include one or more processors of the data analysis platform; non-transitory computer-readable memory storing executable instructions that, when executed, cause the data analysis platform to: receive the sensor data from the data collection platform; analyze the sensor data to determine fuel input information for the plant, air information for the plant, and emissions information for the plant; based on the fuel input information for the plant, the air information for the plant, and the emissions information for the plant, determine an adjustment to an operating parameter of the plant to reduce energy consumption of the plant; and transmit a command configured to cause the adjustment to the operating parameter of the plant. The control platform may include one or more processors of the control platform; non-transitory computer-readable memory storing executable instructions that, when executed, cause the control platform to: receive the command for the adjustment to the operating parameter of the plant; and adjust the operating parameter of the plant.

One or more embodiments may include non-transitory computer-readable media storing executable instructions that, when executed by one or more processors, cause a system to: receive sensor data comprising operating information for a fired heater unit of a plant; analyze the sensor data to determine fuel input information for the plant, air information for the plant, and emissions information for the plant; based on the fuel input information for the plant, the air information for the plant, and the emissions information for the plant, determine an adjustment to an operating parameter of the plant to reduce energy consumption of the plant; and transmit a command configured to cause the adjustment to the operating parameter of the plant.

One or more embodiments may include a method including receiving, by a data analysis computing device, sensor data for a sensor associated with a fired heater unit of a plant; based on analyzing the sensor data, determining, by the data analysis computing device, a current operating condition for an element of the fired heater unit; determining, by the data analysis computing device, a difference between the current operating condition for the element of the fired heater unit and a design operating condition for the element of the fired heater unit; based on the analyzed sensor data, determining, by the data analysis computing device, a command for adjusting the element of the fired heater unit to reduce the difference between the current operating condition and the design operating condition for the element of the fired heater unit; causing, by the data analysis computing device, display of the difference between the current operating condition and the design operating condition on a dashboard outlining recommendations for adjusting the element of the fired heater unit to reduce the difference between the current operating condition and the design operating condition for the element of the fired heater unit; and sending the command for adjusting the element of the fired heater unit to reduce the difference between the current operating condition and the design operating condition for the element of the fired heater unit.

Other technical features may be readily apparent to one skilled in the art from the following figures, descriptions, and claims.

BRIEF DESCRIPTION OF DRAWINGS

The present disclosure is illustrated by way of example and not limited in the accompanying figures in which like reference numerals indicate similar elements and in which:

FIG. 4A illustrates sensors in the convection and stack of a fired heater; FIG. 4B illustrates sensors/transmitters in the radiant section and heater firebox; and FIG. 4C illustrates tube metal temperature indications;

DETAILED DESCRIPTION

In the following description of various illustrative embodiments, reference is made to the accompanying drawings, which form a part hereof, and in which is shown, by way of illustration, various embodiments in which aspects of the disclosure may be practiced. It is to be understood that other embodiments may be utilized, and structural and functional modifications may be made, without departing from the scope of the present disclosure.

It is noted that various connections between elements are discussed in the following description. It is noted that these connections are general and, unless specified otherwise, may be direct or indirect, wired or wireless, and that the specification is not intended to be limiting in this respect.

Chemical processes frequently need heating of process streams. Fired heaters (furnaces or process heaters) are common process units in chemical plants for such heating. A fired heater is a direct-fired heat exchanger that uses the hot gases of combustion to raise the temperature of a process fluid feed flowing through tubes (coils) positioned within the heater. Fired heaters may deliver feed at a predetermined temperature to the next stage of the reaction process or perform reactions such as thermal cracking.

Figure 1:
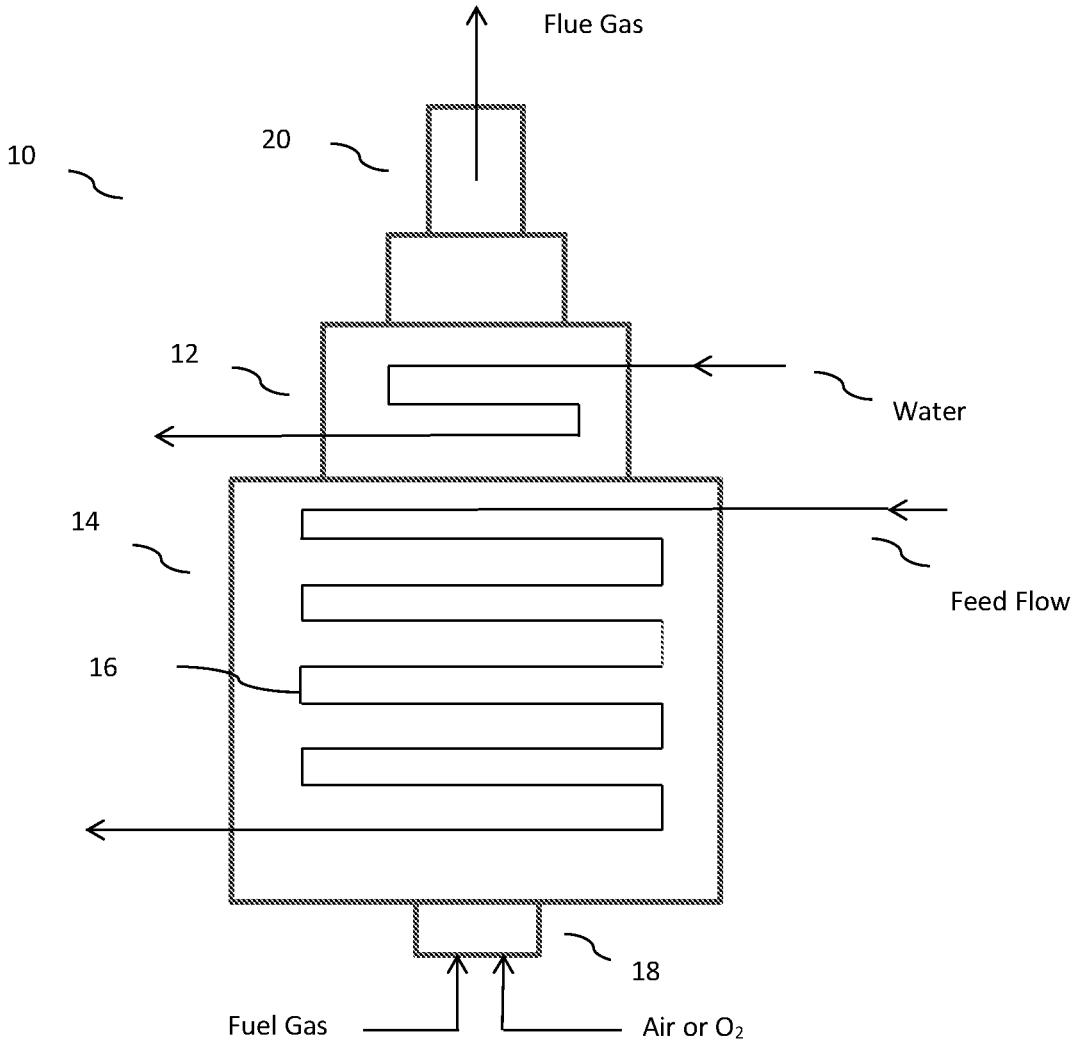
FIG. 1 depicts a schematic of a fired heater for a petroleum cracking process in accordance with one or more example embodiments.

Fired heaters are designed to heat feed streams or intermediate process streams to temperatures necessary for the chemical reactions in the processes to occur at a reasonable rate. Fired heaters used in the petrochemical industry generally utilize both radiant and convective heat transfer and comprise an insulated enclosure containing tubes (coils). As seen in FIG. 1, a fired heater 10 may have a convection section 12 and a radiation section 14 with tubes 16 extending through each section. Process fluid flows in through the tubes 16 in the radiant section 14 for heating. The convection section 12 may be utilized by flowing water through the tubes to make steam with the residual heat. The tubes may be vertical, horizontal, helical, or U-shaped. Fuel gas (or other gas) and oxygen (air) may each flow in through burners 18 mounted on the sides or bottoms of the furnace. The combusted fuel (flue gas) may be discharged via stack 20.

Figure 2:
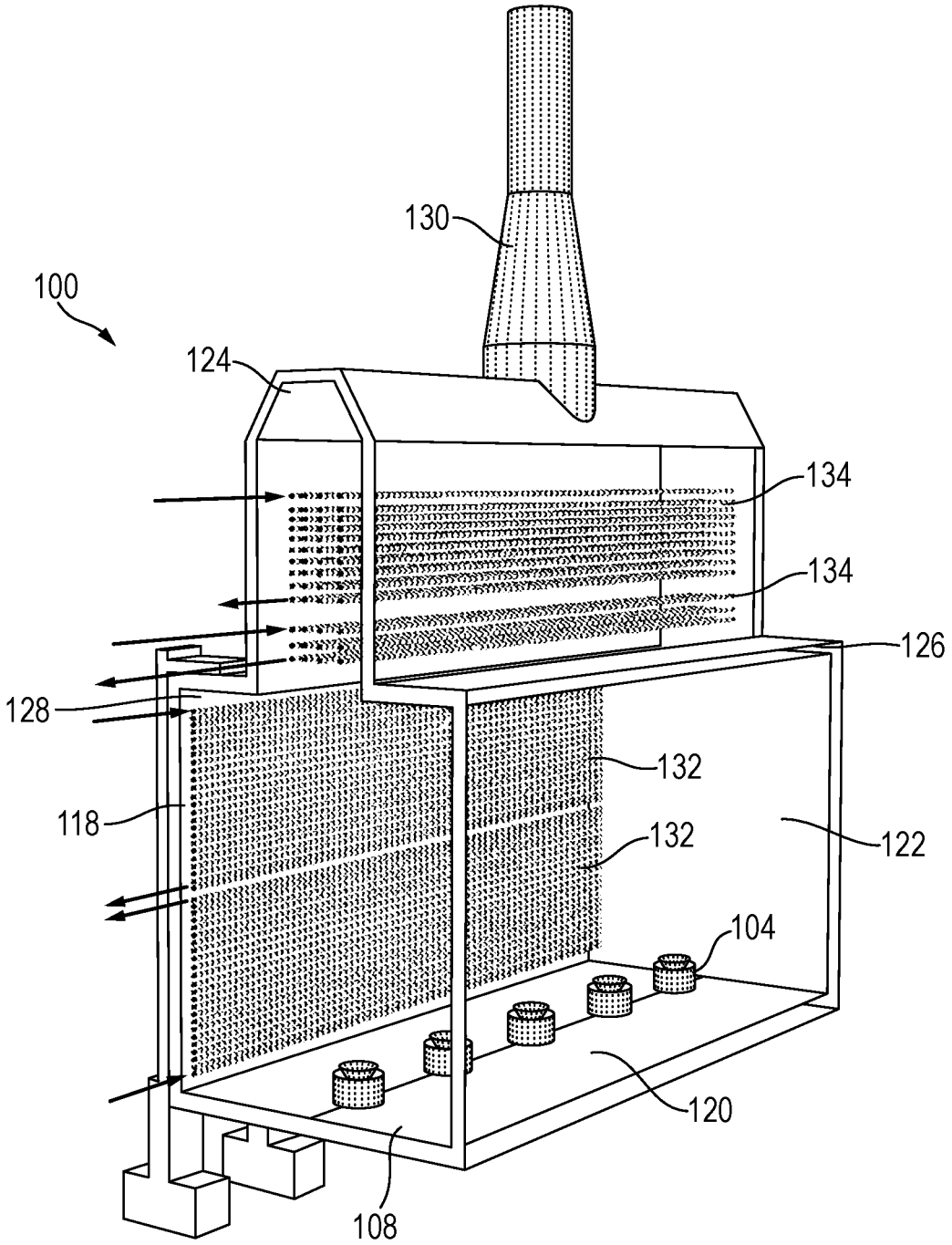
FIG. 2 depicts an illustrative fired heater for a petroleum cracking process in accordance with one or more example embodiments.

A non-limiting example fired heater process 100 is shown in FIG. 2. FIG. 2 is a drawing of one embodiment of a fired heater 100 and indicates the main features without being restricted to the exact geometry shown. This fired heater 100 uses at least one surface burner 104.

The fired heater 100 comprises a firebox 108 having a plurality of walls 118 and a floor 120 which define a radiation section 122, a convection section 124, and a stack 130. Walls 118 may adjoin roof sections 126 which define a transition section 128 (crossover) between the radiation section 122 and the convection section 124. The radiation section 122 contains radiation section tubes 132 and is a portion of the heater in which heat is transferred to the tubes primarily by radiation. The convection section 124 contains the convection section tubes 134 is a portion of the heater in which heat is transferred to the tubes primarily by convection.

Stack 130 is a vertical conduit used to discharge flue gas to the atmosphere. The stack may have a damper (not shown) to introduce variable resistance in order to regulate the flow of flue gas or air. The fired heater may utilize a natural draft—wherein a stack effect induces the combustion air and removal of the flue gases; a forced draft—wherein combustion air is supplied by a fan or mechanical means into the heater; an induced-draft—wherein a fan removes flue gases and maintains negative pressure in the heater to induce combustion air without a forced-draft fan; or a balanced draft—wherein forced-draft fans supply combustion air and induced draft fans remove the flue gases.

In the fired heater 100, product or natural gas may be used as fuel to enter the fired heater 100 through a header (not shown), which distributes the gas into the burners to be combusted. Refractory is used throughout the inside of the heater to shield the heater casing from excess temperatures and is typically castable and ceramic fiber and may be two or more layers.

Heating tubes in the fired heater 100 carry fluid material such as crude oil through the fired heater 100 to be heated. Radiation section tubes 132 are disposed along the walls 118 of the radiation section 122. Banks or rows of convection section tubes 134 are disposed along the walls 118 and through the open space between the walls 118 in the convection section 124. The convection section tubes 134 may have a smooth outside surface or the convection section tubes 134 may have studs or fins welded to the outside surface.

The lowest rows, for example, the lowest three rows, of convection section tubes 134 may be shock tubes 134*a*. These shock tubes 134*a* absorb both radiation heat from the radiation section 122 and convection heat from the flue gas flowing through convection section 124. The shock tubes 134*a* in the lowest banks 136 can be designed thicker than standard furnace shock tubes to accommodate higher temperatures.

The shock tubes 134 a may be specified as 9-Chrome, 1-Molybdenum Schedule 80 AW or 347H austenitic stainless steel tubes Schedule 80 AW, which may be more resistant to corrosion-based fouling due to high-temperature surface oxidation. The other convection section 134 and radiant section tubes 132 may be specified to be 9-Chrome, 1-Molybdenum Schedule 40 AW. Other tube metallurgies may be suitable.

The convection section tubes 134 may be disposed, for example, in a triangular pitch or a square pitch. Multiple banks of convection tubes 134 may be suitable. In an embodiment, 10 to 20 rows of convection tubes 134 may be used, but more or fewer rows of convection tubes may be suitable. Multiple flue gas ducts (not shown) at the top of the convection section 124 may route to one stack 130. In some embodiments, there may be two to four flue gas ducts at the top of the convection section 124 routing flue gas to the stack 130.

Surface burners 104 are provided in the floor 120 of the fired heater 100. Surface burners may be free convection burners which provide oxygen-containing gas such as air through a passageway that directs air in proximity to injected fuel gas to generate a flame. The surface burners 104 can be configured to burn fuel gas or liquid fuel.

Fuel gas is provided to surface burners 104. The surface burners may be continuously fired at a fuel gas flow rate substantially less than maximum capacity and preferably at maximum turndown or minimal capacity, so as to remain lit. In some embodiments, the surface burners 104 may be located in the floor as shown, or the surface burners may be located along the walls.

The surface burners 104 may be arrayed in one or multiple rows on the floor 112 of the radiant section 122 although other arrays may be suitable. Depending on the size and operating parameters, at least one or more burners (e.g., 40 to 200 surface burners) 104 may be provided on the floor 112.

Figure 3:
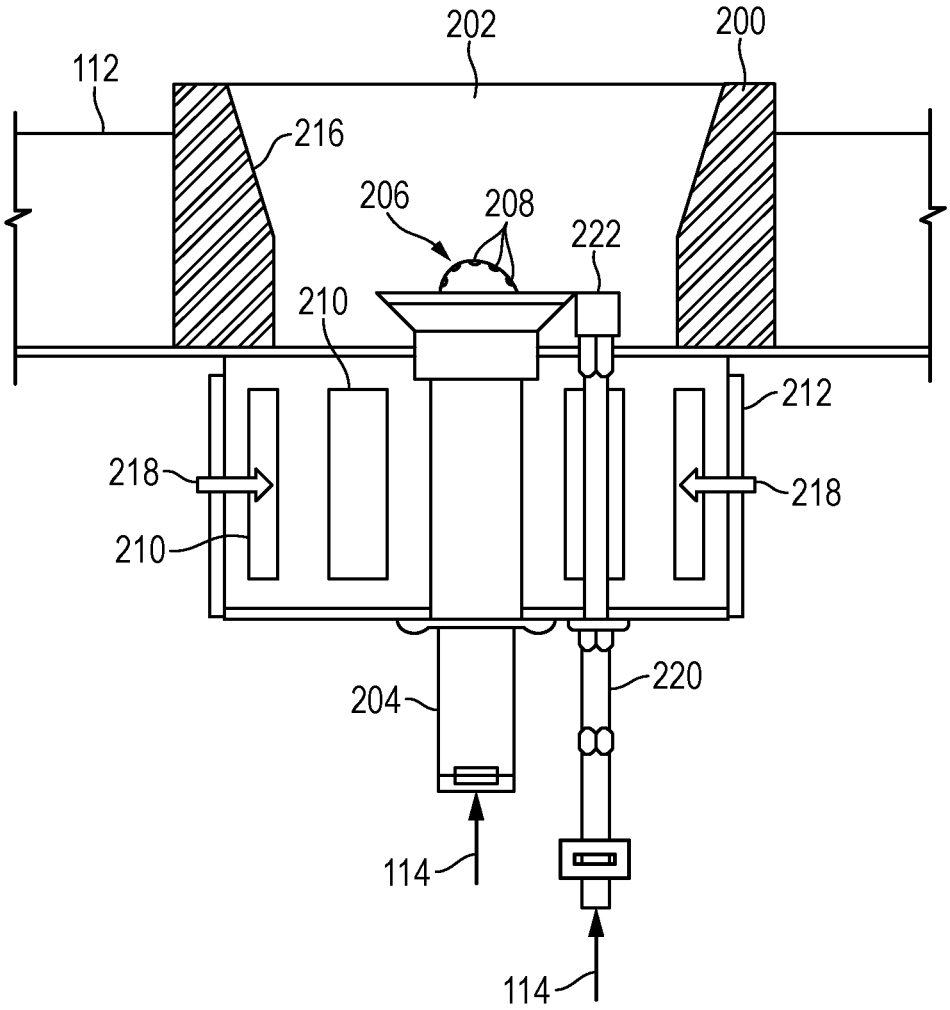
FIG. 3 depicts an illustrative surface burner used in a fired heater for a petroleum cracking process in accordance with one or more example embodiments.

A floor type of surface burner 104 is shown in FIG. 3. The surface burner 104 is disposed in the floor 112 and is surrounded by a tile 200 which defines an inner chamber 202. Fuel gas line 114 from a fuel source feeds fuel gas into pipe 204 in fluid communication with the fuel source. The pipe 204 terminates in a burner tip 206, which may be unitary with or affixed to the pipe 204. Orifices 208 in the burner tip 206 inject fuel gas into the inner chamber 202. Air indicated by arrows 218 is admitted into the surface burner 104 through air intakes 210, which may be vents in an air register chamber 212. The air intakes 210 direct air into proximity with the fuel. A flame holder 214 surrounding the burner tip 206 deflects air away from the burner tip 206, allowing combustion to occur in a very low air velocity zone at the burner tip 206. The flame holder 214 and inner surface of the tile 200 define a passageway 216 that directs air from the air intakes 210 in the air register chamber 212 into proximity with the orifices 208 in the burner tip 206. Orifices 208 in fluid communication with the air intake 210 and the passageway 216 inject fuel into air from the passageway 216. The surface burner directs air and fuel gas into close proximity with each other to promote combustion. A pilot 220 with a burner 222 next to the flame holder 214 in communication with the fuel gas line 114 is provided as an aid to lighting the surface burners 104 during a cold start of the fired heater 20. The pilot 220 also provides a measure of protection against flame out when the fired heater 20 is operated solely with the surface burners 104 lit.

In addition to surface burners, duct burners may be present. Duct burners operate differently than the surface burners 104 by injecting fuel into an oxygen-containing stream that is passing the duct burner, whereas the surface burners 104 provide and direct into close proximity the oxygen-containing stream and the fuel gas necessary for combustion.

Premix burners may also be used as surface burners 104. In a premix burner, an intake that admits air into the pipe (not shown) directs air into proximity with the fuel in the pipe and the orifices inject fuel as well as air. Orifices in fluid communication with said air intake receive air and fuel from the passageway.

Suitable burners may include, for example, Callidus burners by UOP, which may be designed to meet NOx reduction requirements in refinery or petrochemical fired heater applications.

References herein to a "plant" are to be understood to refer to any of various types of chemical and petrochemical manufacturing or refining facilities. References herein to a plant "operators" are to be understood to refer to and/or include, without limitation, plant planners, managers, engineers, technicians, technical advisors, specialists (e.g., in instrumentation, pipe fitting, and welding), shift personnel, and others interested in, starting up, overseeing, monitoring operations of, and shutting down, the plant.

Monitoring Fired Heaters

One of the biggest operating costs in chemical process industries (CPI) is energy. Fired heaters are the major consumers of energy, especially in petroleum refineries and petrochemical plants. Fired heaters can account for as much as 70% of total energy consumption in a plant. One way to attempt to lower this recurring expense is to improve the performance of the fired heaters. Obtaining valuable and/or timely feedback may assist in improving the performance of such fired heaters.

Process equipment used in the fired heater process may deteriorate over time, affecting the performance and integrity of the process. Deteriorating equipment may ultimately fail, but before failing, may decrease efficiency, yield, and/or product properties. Thus, a contributor to poor performance in fired heaters may be a state of disrepair of burners. Such disrepair may be addressed with timely maintenance. In some systems, burners in disrepair may go unnoticed until a near catastrophic event occurs. Therefore, by monitoring equipment performance, fired heaters or fired-heater components (e.g., burners) in need of repair may be identified.

Fired heater equipment may be monitored using one or more sensors to monitor certain conditions or parameters in a fired heater. For example, sensors may be used to monitor data, and a system may be configured to take one or more actions, such as sending one or more alerts or sounding one or more alarms if certain conditions are met.

Examples of measurements that may be taken regarding fired heater equipment may include:

Bridgewall temperature—temperature of flue gas leaving the radiant section.

Radiation loss/setting loss—heat lost to the surroundings from the casing of the heater and ducts and auxiliary equipment.

Volumetric heat release—heat released divided by the net volume of the radiant section, excluding the tubes and refractory dividing walls.

Heat absorption—total heat absorbed by the tubes, excluding any combustion-air preheat.

Fouling resistance—factor used to calculate the overall heat transfer coefficient.

Total heat release—heat liberated from the specified fuel, using the lower heating value of the fuel.

Excess air—amount of air above the stoichiometric requirement for complete combustion (expressed as a %).

Flue gas—gaseous product of combustion including excess air.

Pressure drop—difference between the inlet and the outlet static pressures between termination points, excluding the static differential head.

Fuel efficiency—total heat absorbed divided by the total input of heat derived from the combustion of fuel only (lower heating value basis).

Thermal efficiency—total heat absorbed divided by the total input of heat derived from the combustion of fuel plus sensible heats from air, fuel and any atomizing medium.

Average heat flux density—heat absorbed divided by the exposed surface of the tube section.

Aspects of the system described herein are directed to monitoring and analysis of utility process conditions and interrelationships (e.g., fuel, air, emissions). The system may further provide data, alerts, or automated or manual responses to data, which may allow for corrective actions to avoid unscheduled shutdowns associated with poor performance, e.g., poor burner performance, and/or provide data to help to optimize the performance of fired heaters and/or reduce energy consumption.

For example, monitoring fired heaters may be performed to determine if burner issues or other problems are occurring, or if equipment failures are imminent. Monitoring also helps to collect data that can be correlated and used to predict behavior or problems in different fired heaters used in the same plant or in other plants and/or processes.

Key performance indicators that may be indicative of burner wear or heater imbalance may include, but are not limited to, $O_2$ levels, CO emissions, NOx emissions, fuel gas pressure, TMT variation, and energy savings. Sensors used to gather information used to determine such indicators may include, for example, temperature sensors, pressure sensors, flow sensors, moisture sensors/analyzers, infrared cameras, tunable laser diodes, optical pyrometry, chemical sensors/analyzers, and gas valve position sensors.

Figure 4A:
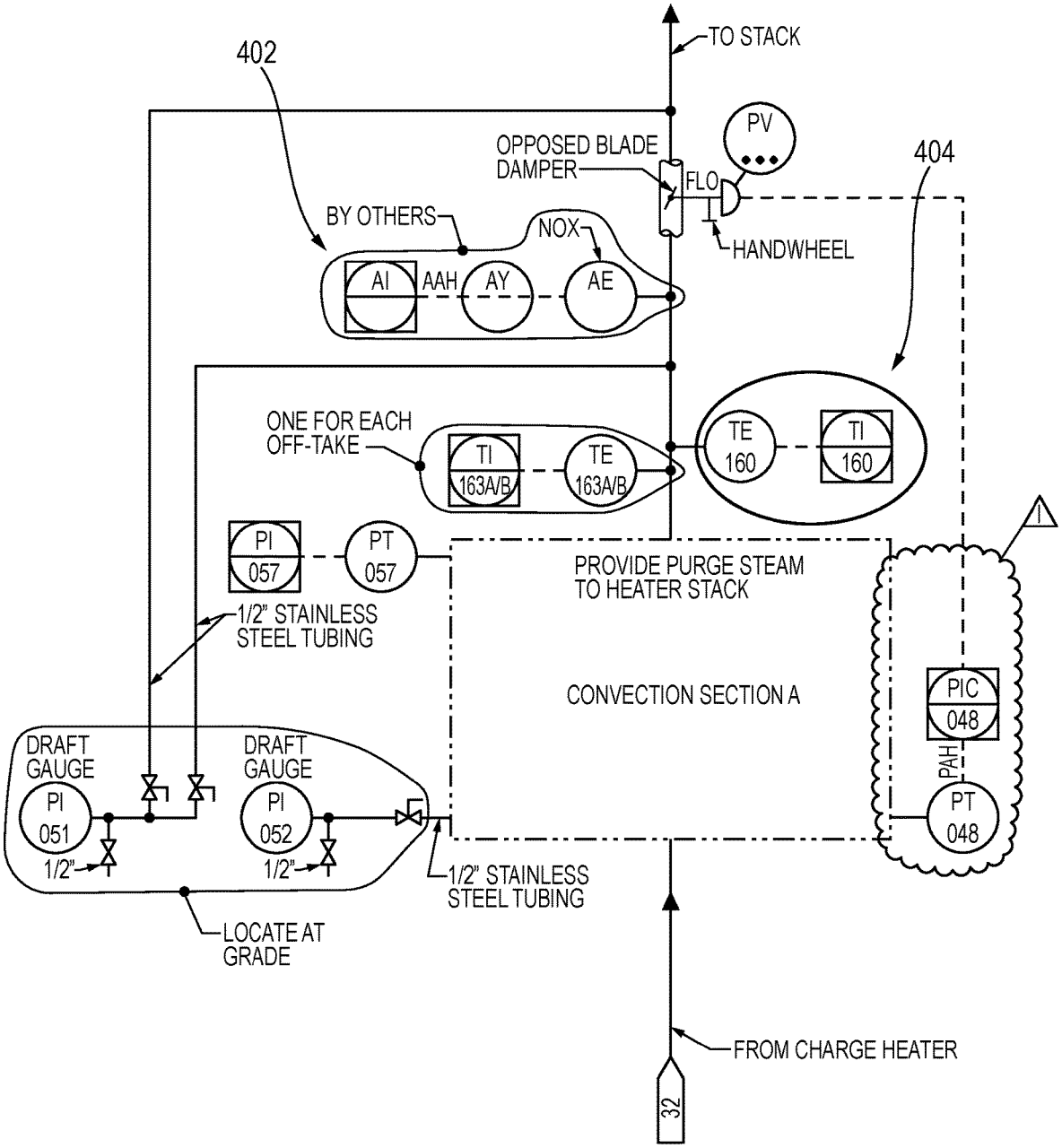
FIGS. 4A-4C depict positions of various sensors in fired heaters, where
Figures 1, 4B:
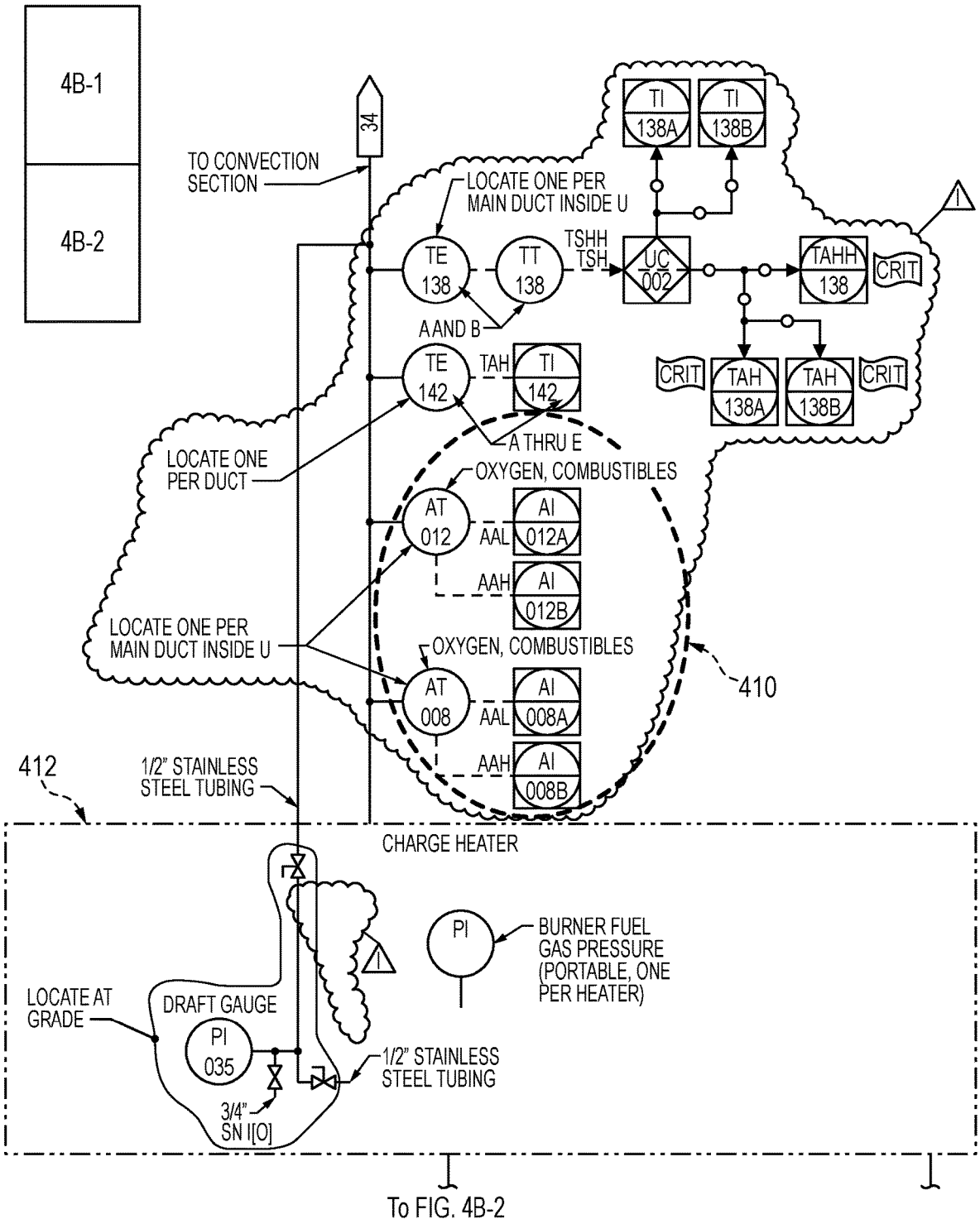
Figures 2, 4B:
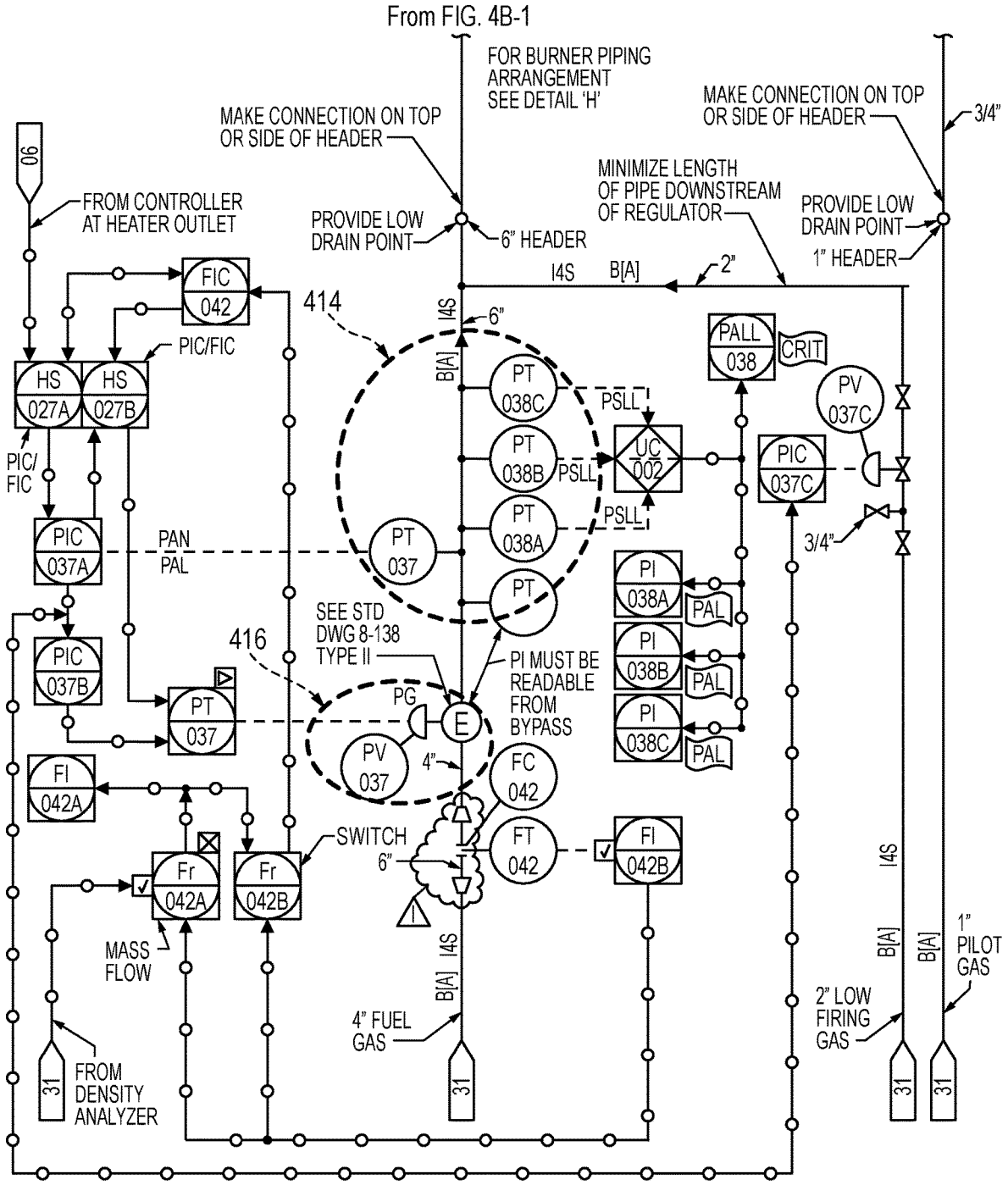
Figure 4C:
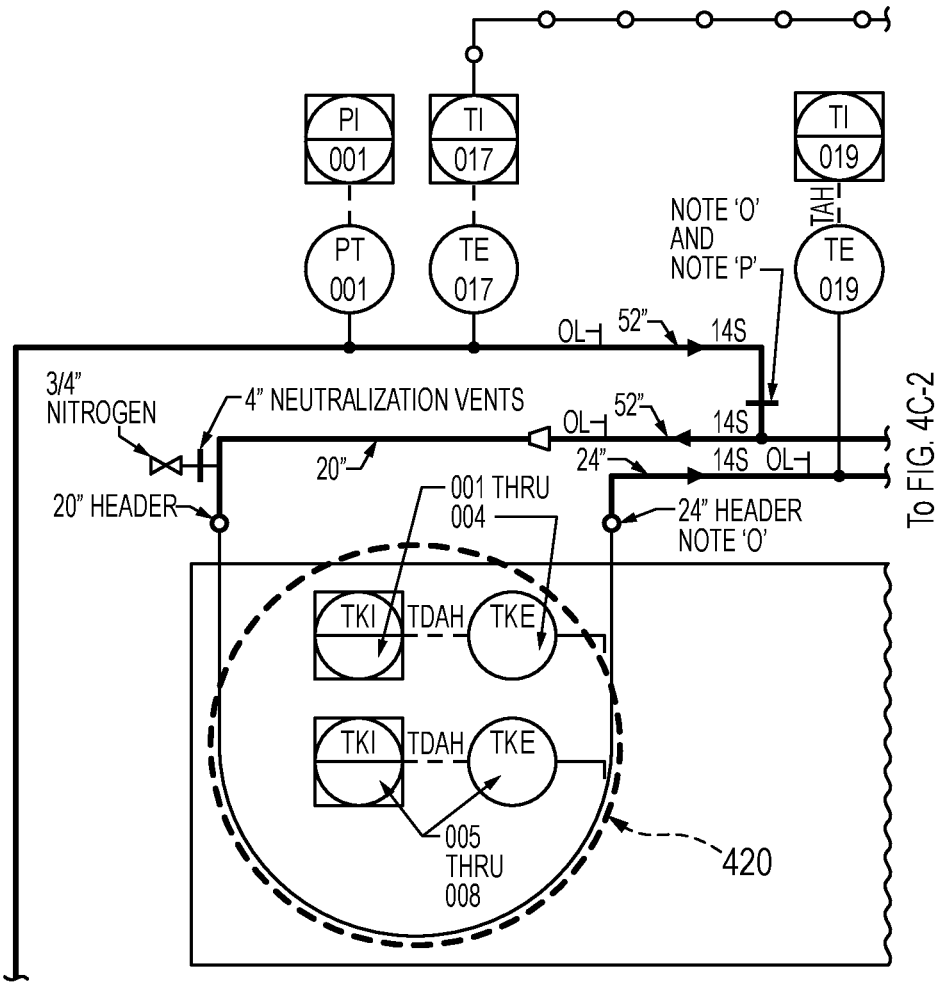
Figure 1:
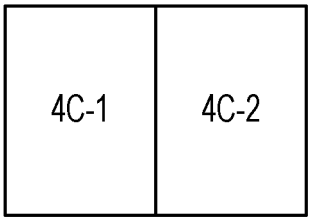
Figures 2, 4C:
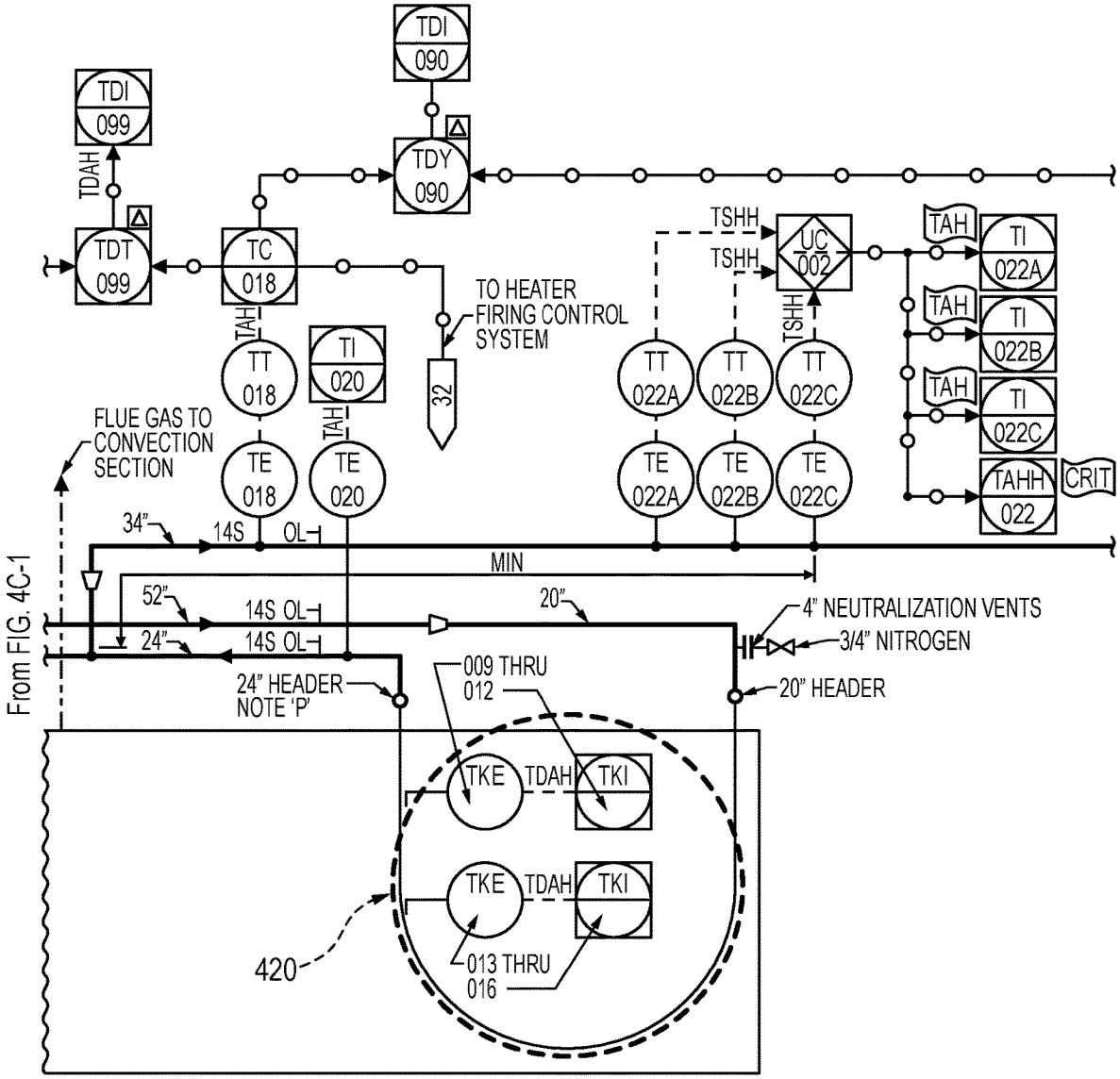

FIGS. 4A-4C illustrate some non-limiting exemplary positions of sensors and transmitters of data in portions of a fired heater. FIG. 4A depicts an illustrative convection section and a stack of a fired heater, and in particular NOx analyzers 402 and stack temperature indicators 404. FIG. 4B illustrates a radiant section and heater firebox of a fired heater, and in particular a charge heater having CO and O2 analyzers 410, heater firebox 412, fuel gas transmitter 414, and valve to adjust fuel gas flow 416. FIG. 4C illustrates tube metal temperature indications 420. These indicators are typical in a fired heater, but often redundant or additional sensors added.

Aspects of the disclosure may be used to identify deteriorating equipment. There may or may not be anything that can be done to correct issues or problems associated with the issues in existing equipment, depending on the cause of the issues. In some aspects, process changes or operating conditions may be altered to preserve the equipment until the next scheduled maintenance period.

Furthermore, elements of plants may be exposed to the outside and thus can be exposed to various environmental stresses. Such stresses may be weather related, such as temperature extremes (hot and cold), high-wind conditions, and precipitation conditions such as snow, ice, and rain. Other environmental conditions may be pollution particulates, such as dust and pollen, or salt if located near an ocean, for example. Such stresses can affect the performance and lifetime of equipment in the plants. Different locations may have different environmental stresses. For example, a refinery in Texas may have different stresses than a chemical plant in Montana. Aspects of the disclosure can be used to identify if such stresses are occurring and suggest corrective action.

Sensor Data Collection and Processing

In some plants, an operational objective may be to improve fired heaters efficiencies on an ongoing and consistent basis. Therefore, a system may deliver timely and/or regular reports indicating current performance, along with interpretation and consulting on what actions may be performed to improve fired heater performance. These actions can include modifications to furnace operating conditions and/or burner maintenance to address fundamental burner performance issues. This system may provide an alternative to a very rudimentary data collection and analysis process, which may yield poor recommendations that are not generated with the required expertise and/or are not provided in a timely manner. The system may provide improved reporting and recommendations via a software monitoring system that delivers a timely report (e.g., web based), and/or additional recommendations, alerts, or triggers of remedial or corrective actions.

Figure 5A:
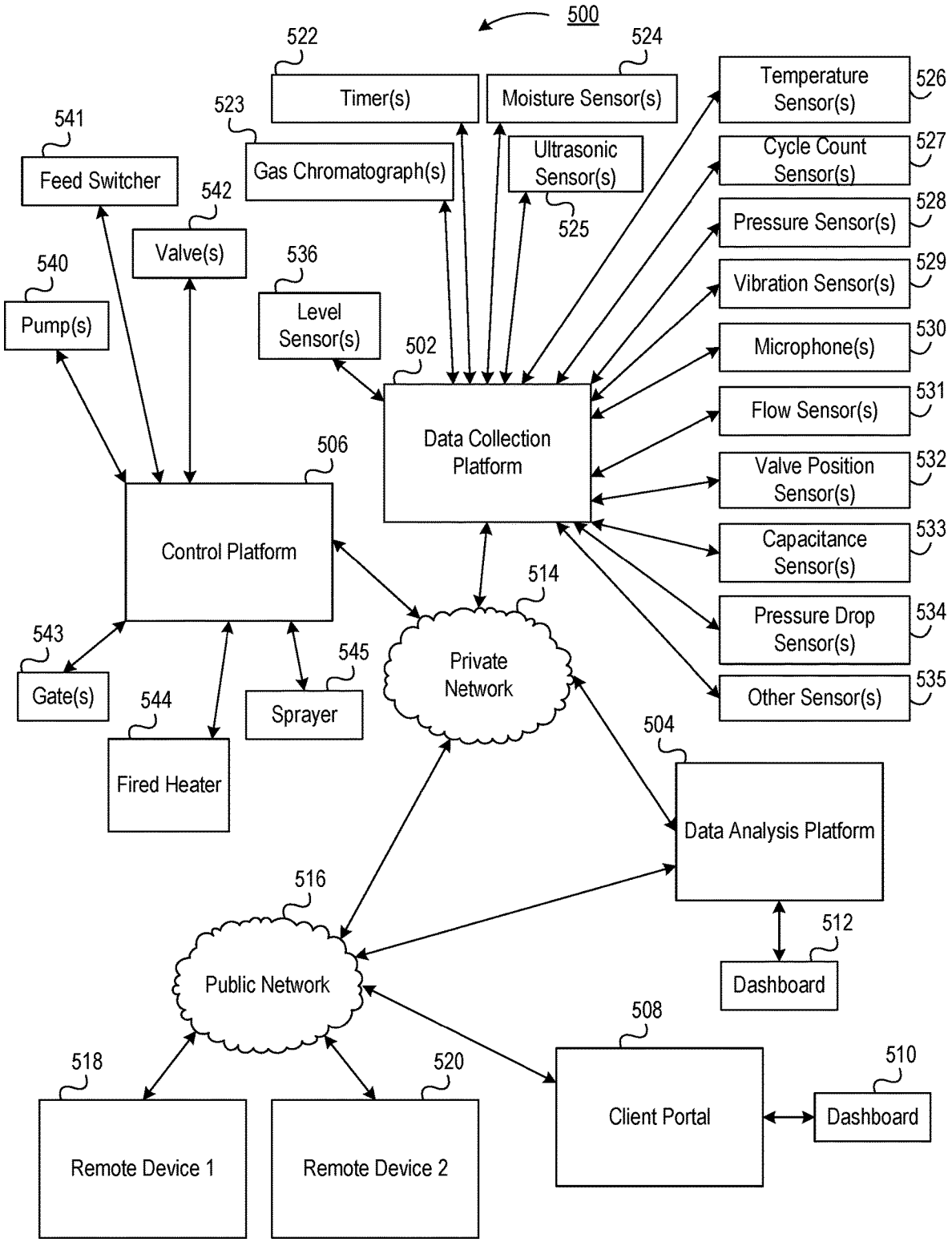
FIG. 5A depicts an illustrative computing environment for managing the operation of one or more pieces of equipment in a plant in accordance with one or more example embodiments.

The system may include one or more computing devices or platforms for collecting, storing, processing, and analyzing data from one or more sensors. FIG. 5A depicts an illustrative computing system that may be implemented at one or more components, pieces of equipment (e.g., fired heaters), and/or plants. FIG. 5A-FIG. 5E (hereinafter collectively "FIG. 5"), show, by way of illustration, various components of the illustrative computing system in which aspects of the disclosure may be practiced. It is to be understood that other components may be used, and structural and functional modifications may be made, in one or more other embodiments without departing from the scope of the present disclosure. Moreover, various connections between elements are discussed in the following description, and these connections are general and, unless specified otherwise, may be direct or indirect, wired or wireless, and/or combination thereof, and that the specification is not intended to be limiting in this respect.

FIG. 5A depicts an illustrative operating environment in which various aspects of the present disclosure may be implemented in accordance with example embodiments. The computing system environment 500 illustrated in FIG. 5A is only one example of a suitable computing environment and is not intended to suggest any limitation as to the scope of use or functionality contained in the disclosure. The computing system environment 500 may include various sensor, measurement, and data capture systems, a data collection platform 502, a data analysis platform 504, a control platform 506, a client portal 508, one or more networks, one or more remote devices, and/or one or more other elements. The numerous elements of the computing system environment 500 of FIG. 5A may be communicatively coupled through one or more networks. For example, the numerous platforms, devices, sensors, and/or components of the computing system environment may be communicatively coupled through a private network 514. The sensors be positioned on various components in the plant and may communicate wirelessly or wired with one or more platforms illustrated in FIG. 5A. The private network 514 may comprise, in some examples, a network firewall device to prevent unauthorized access to the data and devices on the private network 514. Alternatively, the private network 514 may be isolated from external access through physical means, such as a hard-wired network with no external, direct-access point. The data communicated on the private network 514 may be optionally encrypted for further security. Depending on the frequency of collection and transmission of sensor measurements and other data to the data collection platform 502, the private network 514 may experience large bandwidth usage and be technologically designed and arranged to accommodate for such technological issues. Moreover, the computing system environment 500 may also include a public network 516 that may be accessible to remote devices (e.g., remote device 518, remote device 520). In some examples, the remote device (e.g., remote device 518, remote device 520) may be located not in the proximity (e.g., more than one mile away) of the various sensor, measurement, and data capture systems illustrated in FIG. 5A. In other examples, the remote device (e.g., remote device 518, remote device 520) may be physically located inside a plant, but restricted from access to the private network 514; in other words, the adjective "remote,"

need not necessarily require the device to be located at a great distance from the sensor systems and other components.

Although the computing system environment 500 of FIG. 5A illustrates logical block diagrams of numerous platforms and devices, the disclosure is not so limited. In particular, one or more of the logical boxes in FIG. 5 may be combined into a single logical box or the functionality performed by a single logical box may be divided across multiple existing or new logical boxes. For example, aspects of the functionality performed by the data collection platform 502 may be incorporated into one or each of the sensor devices illustrated in FIG. 5A. As such, the data collection may occur local to the sensor device, and the enhanced sensor system may communicate directly with one or more of the control platform and/or data analysis platform. Such an embodiment is contemplated by FIG. 5A. Moreover, in such an embodiment, the enhanced sensor system may measure values common to a sensor, but may also filter the measurements such just those values that are statistically relevant or of-interest to the computing system environment are transmitted by the enhanced sensor system. As a result, the enhanced sensor system may include a processor (or other circuitry that enables execution of computer instructions) and a memory to store those instructions and/or filtered data values. The processor may be embodied as an application-specific integrated circuit (ASIC), FPGA, or other hardware- or software-based module for execution of instructions. In another example, one or more sensors illustrated in FIG. 5A may be combined into an enhanced, multi-purpose sensor system. Such a combined sensor system may provide economies of scale with respect to hardware components such as processors, memories, communication interfaces, and others.

In yet another example, the data collection platform 502 and data analysis platform 504 may reside on a single server computer or virtual machine and be depicted as a single, combined logical box on a system diagram. Moreover, a data store may be separate and apart from the data collection platform 502 and data analysis platform 504 to store a large amount of values collected from sensors and other components. The data store may be embodied in a database format and may be made accessible to the public network 516; meanwhile, the control platform 506, data collection platform 502, and data analysis platform 504 may be restricted to the private network 514 and left inaccessible to the public network 516. As such, the data collected from a plant may be shared with users (e.g., engineers, data scientists, others), a company's employees, and even third parties (e.g., subscribers to the company's data feed) without compromising potential security requirements related to operation of a plant. The data store may be accessible to one or more users and/or remote devices over the public network 516.

Referring to FIG. 5A, process measurements from various sensor and monitoring devices may be used to monitor conditions in, around, and on process equipment (e.g., fired heaters 544). Such sensors may include, but are not limited to, pressure sensors 528, differential pressure sensors, pressure drop sensors 534, other flow sensors, temperature sensors 526 including thermal cameras and skin thermocouples, capacitance sensors 533, weight sensors, microphones 530, gas chromatographs 523, moisture sensors 524, ultrasonic sensors 525, position sensors (e.g., valve position sensors 532), timing sensors (e.g., timer 522), vibration sensors 529, level sensors 536, liquid level (hydraulic fluid) sensors, cycle count sensors 527, and other sensors 535 commonly found in the refining and petrochemical industry. Further, process laboratory measurements may be taken using gas chromatographs 523, liquid chromatographs, distillation measurements, octane measurements, and other laboratory measurements. System operational measurements also can be taken to correlate the system operation to the fired heater measurements.

In addition, sensors may include transmitters and deviation alarms. These sensors may be programmed to set off an alarm, which may be audible and/or visual.

Other sensors may transmit signals to a processor or a hub that collects the data and sends to a processor. For example, temperature and pressure measurements may be sent to a hub (e.g., data collection platform 502). In one example, temperature sensors 526 may include thermocouples, fiber optic temperature measurement, thermal cameras, and/or infrared cameras. Skin thermocouples may be applied to tubes or placed directly on a wall of a fired heater unit. Alternatively, thermal (infrared) cameras may be used to detect temperature (e.g., hot spots) in one or more aspects of the equipment, including tubes. A shielded (insulated) tube skin thermocouple assembly may be used to obtain accurate measurements. One example of a thermocouple may be a removable XTRACTO Pad. A thermocouple can be replaced without any additional welding. Clips and/or pads may be utilized for ease of replacement. Fiber Optic cable can be attached to a unit, line, or vessel to provide a complete profile of temperatures.

Furthermore, flow sensors 531 may be used in flow paths such as the inlet to the path, outlet from the path, or within the path. If multiple tubes are utilized, the flow sensors 531 may be placed in corresponding positions in each of the tubes. In this manner, one can determine if one of the tubes is behaving abnormally compared to other tubes. Flow may be determined by pressure-drop across a known resistance, such as by using pressure taps. Other types of flow sensors 531 include, but are not limited to, ultrasonic, turban meter, hot wire anemometer, vane meter, Kármán™, vortex sensor, membrane sensor (membrane has a thin film temperature sensor printed on the upstream side, and one on the downstream side), tracer, radiographic imaging (e.g., identify two-phase vs. single-phase region of channels), an orifice plate in front of or integral to each tube or channel, pitot tube, thermal conductivity flow meter, anemometer, internal pressure flow profile, and/or measure cross tracer (measuring when the flow crosses one plate and when the flow crosses another plate).

Moisture level sensors 524 may be used to monitor moisture levels at one or more locations. For example, moisture levels at an outlet may be measured. Additionally, moisture levels at an inlet or at a predetermined depth within the fired heater unit may be measured. In some embodiments, a moisture level at an inlet may be known (e.g., a feed is used that has a known moisture level or moisture content).

A gas chromatograph 523 on the feed or fuel gas to the fired heater can be used to speciate the various components to provide empirical data to be used in calculations.

Sensor data, process measurements, and/or calculations made using the sensor data or process measurements may be used to monitor and/or improve the performance of the equipment and parts making up the equipment, as discussed in further detail below. For example, sensor data may be used to detect that a desirable or an undesirable chemical reaction is taking place within a particular piece of equipment, and one or more actions may be taken to encourage or inhibit the chemical reaction. Chemical sensors may be used to detect the presence of one or more chemicals or components in the streams, such as corrosive species, oxygen, hydrogen, and/or water (moisture). Chemical sensors may utilize gas chromatographs 523, liquid chromatographs, distillation measurements, and/or octane measurements. In another example, equipment information, such as wear, efficiency, production, state, or other condition information, may be gathered and determined based on sensor data.

Corrective action may be taken based on determining this equipment information. For example, if the equipment is showing signs of wear or failure, corrective actions may be taken, such as taking an inventory of parts to ensure replacement parts are available, ordering replacement parts, and/or calling in repair personnel to the site. Certain parts of equipment may be replaced immediately. Other parts may be safe to continue to use, but a monitoring schedule may be adjusted. A control platform (e.g., control platform 506) may send one or more signals to automatically adjust one or more valves 542, pipes, gates 543, sprayers 545, pumps 540, feeds (e.g., using feed switcher 541), inputs or settings of a fired heater (e.g., fired heater 544) or the like. Alternatively or additionally, one or more inputs or controls relating to a process may be adjusted as part of the corrective action. These and other details about the equipment, sensors, processing of sensor data, and actions taken based on sensor data are described in further detail below.

Monitoring the fired heaters and the processes using fired heaters includes collecting data that can be correlated and used to predict behavior or problems in different the fired heater used in the same plant or in other plants and/or processes. Data collected from the various sensors (e.g., measurements such as flow, pressure drop, thermal performance, vessel skin temperature at the top, vibration) may be correlated with external data, such as environmental or weather data. Process changes or operating conditions may be able to be altered to preserve the equipment until the next scheduled maintenance period. Fluids may be monitored for corrosive contaminants and pH may be monitored in order to predict higher than normal corrosion rates within the fired heater equipment. At a high level, sensor data collected (e.g., by the data collection platform 502) and data analysis (e.g., by the data analysis platform 504) may be used together, for example, for process simulation, equipment simulation, and/or other tasks. For example, sensor data may be used for process simulation and reconciliation of sensor data. The resulting, improved process simulation may provide a stream of physical properties that are used to calculate heat flow, etc. These calculations may lead to thermal and pressure drop performance prediction calculations for specific equipment, and comparisons of equipment predictions to observations from the operating data (e.g., predicted/expected outlet temperature and pressure vs. measured outlet temperature and pressure). This causes identification of one or issues that may eventually lead to a potential control changes and/or recommendations, etc.

Systems Facilitating Sensor Data Collection

Sensor data may be collected by a data collection platform 502. The sensors may interface with the data collection platform 502 via wired or wireless transmissions. Sensor data (e.g., temperature data) may be collected continuously or at periodic intervals (e.g., every second, every five seconds, every ten seconds, every minute, every five minutes, every ten minutes, every hour, every two hours, every five hours, every twelve hours, every day, every other day, every week, every other week, every month, every other month, every six months, every year, or another interval). Data may be collected at different locations at different intervals. For example, data at a known hot spot may be collected at a first interval, and data at a spot that is not a known hot spot may be collected at a second interval. The data collection platform 502 may continuously or periodically (e.g., every second, every minute, every hour, every day, once a week, once a month) transmit collected sensor data to a data analysis platform, which may be nearby or remote from the data collection platform.

Figure 5B:
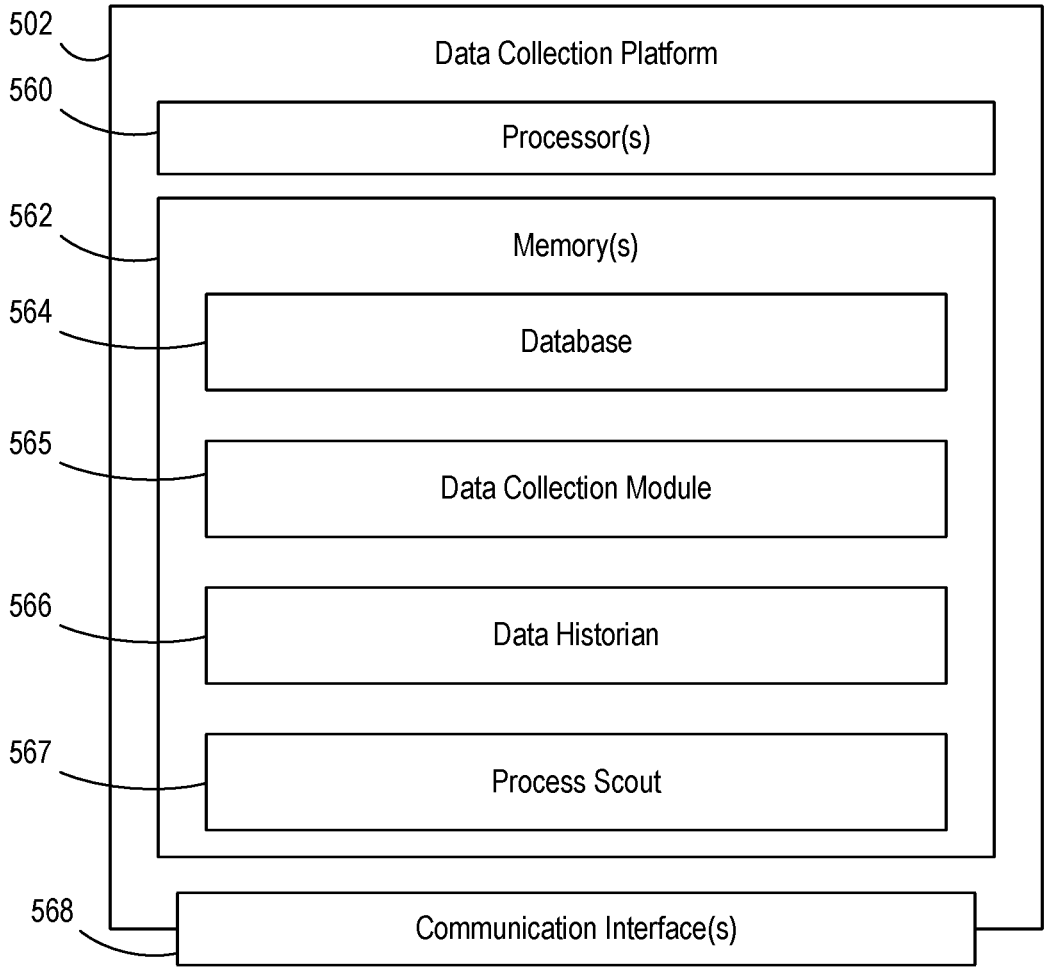
FIG. 5B depicts an illustrative data collection computing platform for collecting data related to the operation of one or more pieces of equipment in a plant in accordance with one or more example embodiments.
Figure 5C:
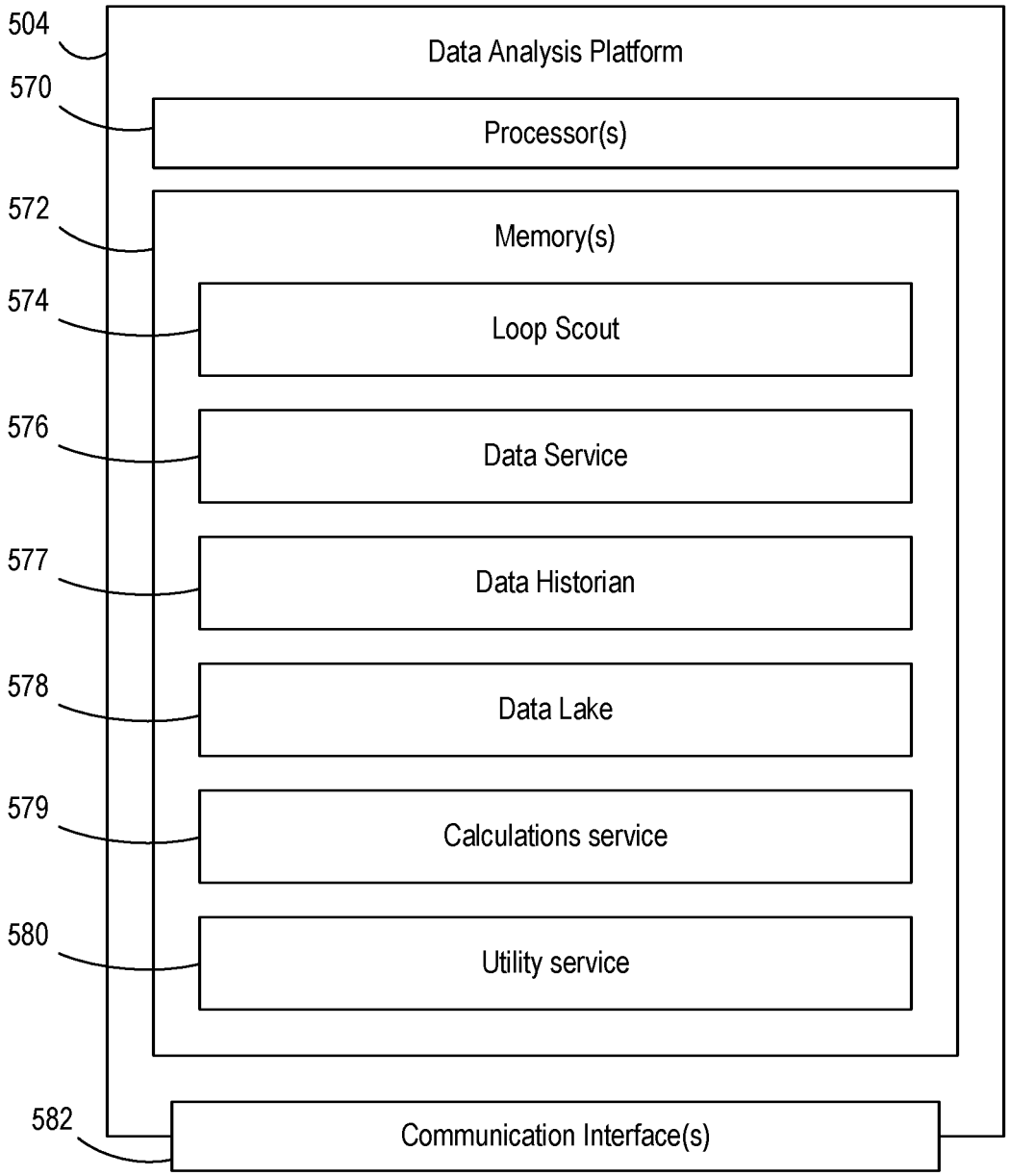
FIG. 5C depicts an illustrative data analysis computing platform for analyzing data related to the operation of one or more pieces of equipment in a plant in accordance with one or more example embodiments.
Figure 5D:
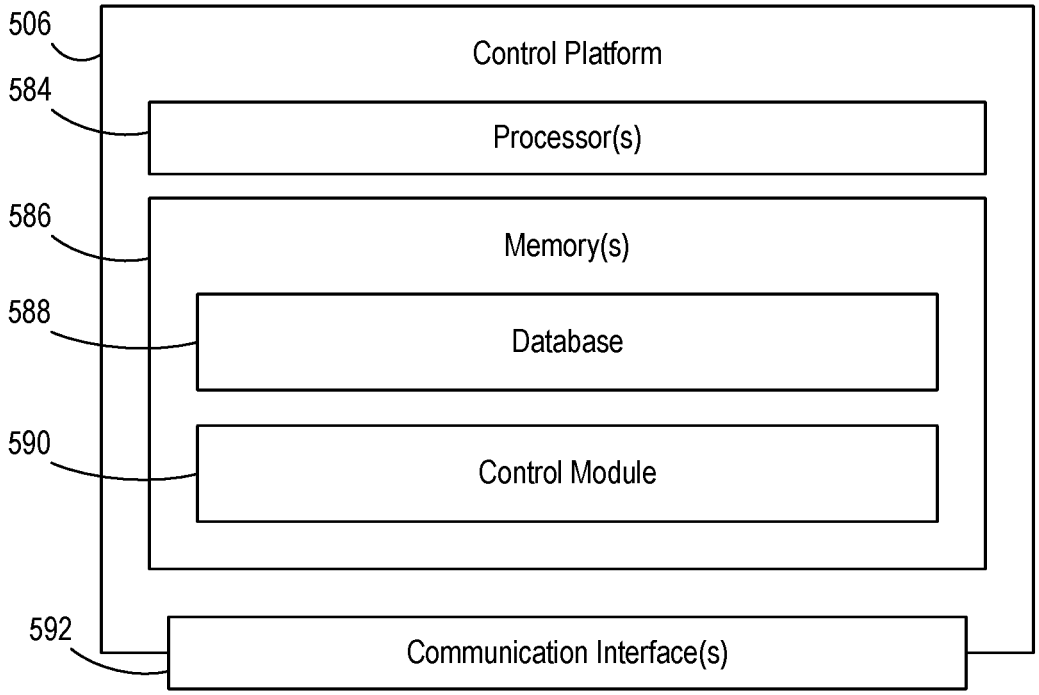
FIG. 5D depicts an illustrative data analysis computing platform for analyzing data related to the operation of one or more pieces of equipment in a plant in accordance with one or more example embodiments.
Figure 5E:
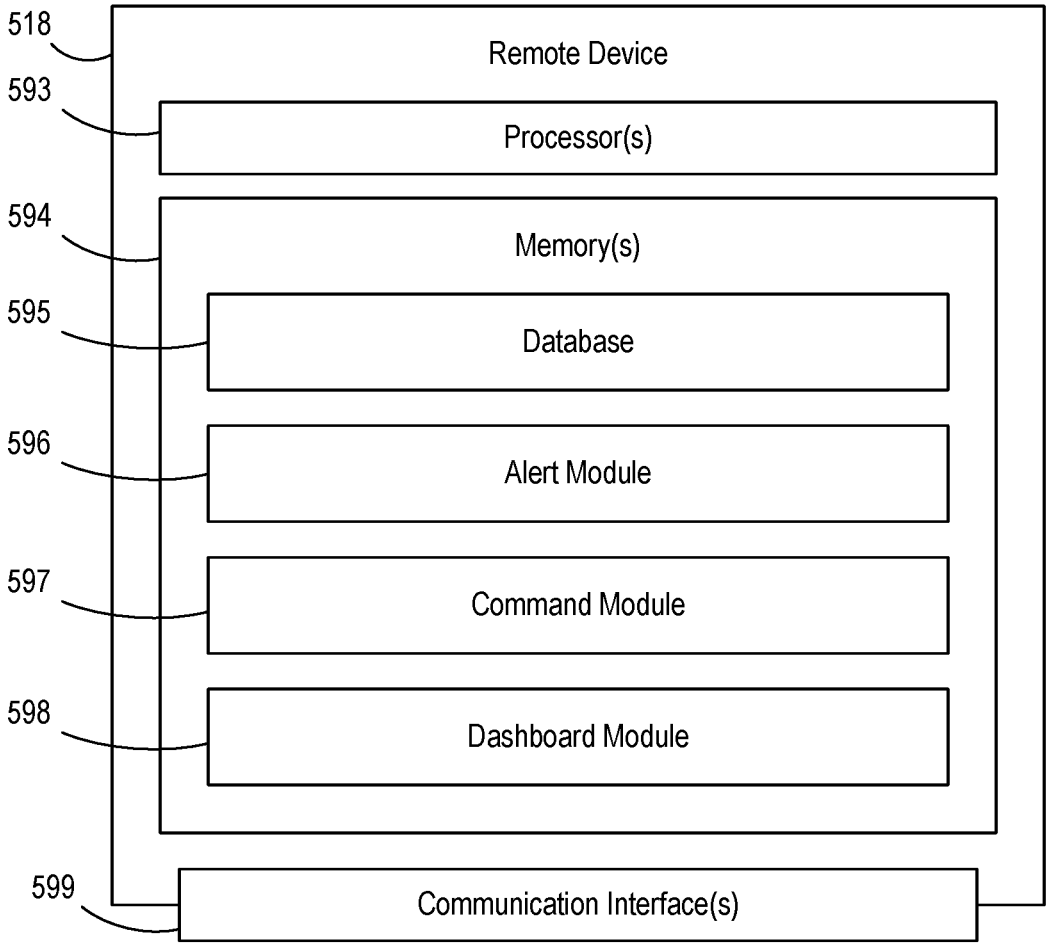
FIG. 5E depicts an illustrative control computing platform for controlling one or more parts of one or more pieces of equipment in a plant in accordance with one or more example embodiments.

The computing system environment 500 of FIG. 5A includes logical block diagrams of numerous platforms and devices that are further elaborated upon in FIG. 5B, FIG. 5C, FIG. 5D, and FIG. 5E. FIG. 5B is an illustrative data collection platform 502. FIG. 5C is an illustrative data analysis platform 504. FIG. 5D is an illustrative control platform 506. FIG. 5E is an illustrative remote device 518. These platforms and devices of FIG. 5 include one or more processing units (e.g., processors) to implement the methods and functions of certain aspects of the present disclosure in accordance with the example embodiments. The processors may include general-purpose microprocessors and/or special-purpose processors designed for particular computing system environments or configurations. For example, the processors may execute computer-executable instructions in the form of software and/or firmware stored in the memory of the platform or device. Examples of computing systems, environments, and/or configurations that may be suitable for use with the disclosed embodiments include, but are not limited to, personal computers (PCs), server computers, hand-held or laptop devices, smart phones, multiprocessor systems, microprocessor-based systems, programmable consumer electronics, network PCs, minicomputers, mainframe computers, virtual machines, distributed computing environments that include any of the above systems or devices, and the like.

In addition, the platform and/or devices in FIG. 5 may include one or more memories of a variety of computer-readable media. Computer-readable media may be any available media that may be accessed by the data collection platform, may be non-transitory, and may include volatile and nonvolatile, removable and non-removable media implemented in any method or technology for storage of information such as computer-readable instructions, object code, data structures, database records, program modules, or other data. Examples of computer-readable media may include random access memory (RAM), read only memory (ROM), electronically erasable programmable read only memory (EEPROM), flash memory or other memory technology, compact disk read-only memory (CD-ROM), digital versatile disks (DVD) or other optical disk storage, magnetic cassettes, magnetic tape, magnetic disk storage or other magnetic storage devices, or any other medium that can be used to store the desired information and that can be accessed by the data collection platform. The memories in the platform and/or devices may further store modules that may comprise compiled software code that causes the platform, device, and/or overall system to operate in a technologically improved manner as disclosed herein. For example, the memories may store software used by a computing platform, such as operating system, application programs, and/or associated database. Alternatively or additionally, a module may be implemented in a virtual machine or multiple virtual machines.

Furthermore, the platform and/or devices in FIG. 5 may include one or more communication interfaces including, but not limited to, a microphone, keypad, touch screen, and/or stylus through which a user of a computer (e.g., a remote device) may provide input, and may also include a speaker for providing audio output and a video display device for providing textual, audiovisual and/or graphical output. The communication interfaces may include a network controller for electronically communicating (e.g., wirelessly or wired) over a public network or private network with one or more other components on the network. The network controller may include electronic hardware for communicating over network protocols, including TCP/IP, UDP, Ethernet, and other protocols.

In some examples, one or more sensor devices in FIG. 5A may be enhanced by incorporating functionality that may otherwise be found in a data collection platform 502. These enhanced sensor system may provide further filtering of the measurements and readings collected from their sensor devices. For example, with some of the enhanced sensor systems in the operating environment illustrated in FIG. 5A, an increased amount of processing may occur at the sensor so as to reduce the amount of data needing to be transferred over a private network 514 in real-time to a computing platform. The enhanced sensor system may filter at the sensor itself the measured/collected/captured data and only particular, filtered data may be transmitted to the data collection platform 502 for storage and/or analysis.

Referring to FIG. 5B, in one example, a data collection platform 502 may comprise a processor 560, one or more memories 562, and communication interfaces 568. The memory 562 may comprise a database 564 for storing data records of various values collected from one or more sources. In addition, a data collection module 565 may be stored in the memory 562 and assist the processor 560 in the data collection platform 502 in communicating with, via the communications interface 568, one or more sensor, measurement, and data capture systems, and processing the data received from these sources. In some embodiments, the data collection module 565 may comprise computer-executable instructions that, when executed by the processor, cause the data collection platform to perform one or more of the steps disclosed herein. In other embodiments, the data collection module 565 may be a hybrid of software-based and/or hardware-based instructions to perform one or more of the steps disclosed herein. In some examples, the data collection module 565 may assist an enhanced sensor system with further filtering the measurements and readings collected from the sensor devices. In some examples, the data collection module may receive some or all data from a plant or piece of equipment, and/or may provide that data to one or more other modules or servers.

Data collection platform 502 may include or be in communication with one or more data historians 566. The data historian 566 may be implemented as one or more software modules, one or more virtual machines, or one or more hardware elements (e.g., servers). The data historian may collect data at regular intervals (e.g., every minute, every two minutes, every ten minutes, every thirty minutes).

The data historian 566 may include or be in communication with a process scout 567. The process scout 567 may be implemented as one or more software modules, one or more virtual machines, or one or more hardware elements (e.g., servers). The process scout 567 may work with or in place of the data collection module 565 and/or the data historian 566 to handle one or more aspects of data replication.

Although the elements of FIG. 5B are illustrated as logical block diagrams, the disclosure is not so limited. In particular, one or more of the logical boxes in FIG. 5B may be combined into a single logical box or the functionality performed by a single logical box may be divided across multiple existing or new logical boxes. Moreover, some logical boxes that are visually presented as being inside of another logical box may be moved such that they are partially or completely residing outside of that logical box. For example, while the database in FIG. 5B is illustrated as being stored inside one or more memories in the data collection platform 502, FIG. 5B contemplates that the database may be stored in a standalone data store communicatively coupled to the data collection module 565 and processor 560 of the data collection platform 502 via the communications interface 568 of the data collection platform 502.

In addition, the data collection module 565 may assist the processor 560 in the data collection platform 502 in communicating with, via the communications interface 568, and processing data received from other sources, such as data feeds from third-party servers and manual entry at the field site from a dashboard graphical user interface. For example, a third-party server may provide contemporaneous weather data to the data collection module. Some elements of chemical and petrochemical/refinery plants may be exposed to the outside and thus may be exposed to various environmental stresses. Such stresses may be weather related such as temperature extremes (hot and cold), high wind conditions, and precipitation conditions such as snow, ice, and rain. Other environmental conditions may be pollution particulates such as dust and pollen, or salt if located near an ocean, for example. Such stresses can affect the performance and lifetime of equipment in the plants. Different locations may have different environmental stresses. For example, a refinery in Texas will have different stresses than a chemical plant in Montana. In another example, data manually entered from a dashboard graphical user interface (or other means) may be collected and saved into memory by the data collection module. Production rates may be entered and saved in memory. Tracking production rates may indicate issues with flows. For example, as fouling occurs, the production rate may fall if a specific outlet temperature can no longer be achieved at the targeted capacity and capacity has to be reduced to maintain the targeted outlet temperature.

Referring to FIG. 5C, in one example, a data analysis platform 504 may comprise a processor 570, one or more memories 572, and communication interfaces 582. The memory 572 may comprise a database for storing data records of various values collected from one or more sources. Alternatively, the database may be the same database as that depicted in FIG. 5B and the data analysis platform 504 may communicatively couple with the database via the communication interface 582 of the data analysis platform 504. At least one advantage of sharing a database between the two platforms is the reduced memory requirements due to not duplicating the same or similar data.

In addition, the data analysis platform 504 may include a loop scout 574. In some embodiments, the loop scout 574 may comprise computer-executable instructions that, when executed by the processor, cause the data analysis platform to perform one or more of the steps disclosed herein. In other embodiments, the loop scout 574 may be a virtual machine. In some embodiments, the loop scout 574 may be a hybrid of software-based and/or hardware-based instructions to perform one or more of the steps disclosed herein.

Further, the data analysis platform 504 may include a data service 576. In some embodiments, the data service 576 may comprise computer-executable instructions that, when executed by the processor, cause the data analysis platform 504 to perform one or more of the steps disclosed herein. In other embodiments, the data service 576 may be a virtual machine. In some embodiments, the data service 576 may be a hybrid of software-based and/or hardware-based instructions to perform one or more of the steps disclosed herein.

Also, the data analysis platform 504 may include a data historian 577. In some embodiments, the data historian 577 may comprise computer-executable instructions that, when executed by the processor, cause the data analysis platform 504 to perform one or more of the steps disclosed herein. In other embodiments, the data historian 577 may be a virtual machine. In some embodiments, the data historian 577 may be a hybrid of software-based and/or hardware-based instructions to perform one or more of the steps disclosed herein. The data historian 577 may collect data at regular intervals (e.g., every minute, every two minutes, every ten minutes, every thirty minutes).

Additionally, the data analysis platform 504 may include a data lake 578. In some embodiments, the data lake 578 may comprise computer-executable instructions that, when executed by the processor, cause the data analysis platform 504 to perform one or more of the steps disclosed herein. In other embodiments, the data lake 578 may be a virtual machine. In some embodiments, the data lake 578 may be a hybrid of software-based and/or hardware-based instructions to perform one or more of the steps disclosed herein. The data lake 578 may perform relational data storage. The data lake 578 may provide data in a format that may be useful for processing data and/or performing data analytics.

Moreover, the data analysis platform 504 may include a calculations service 579. In some embodiments, the calculations service 579 may comprise computer-executable instructions that, when executed by the processor, cause the data analysis platform 504 to perform one or more of the steps disclosed herein. In other embodiments, the calculations service 579 may be a virtual machine. In some embodiments, the calculations service 579 may be a hybrid of software-based and/or hardware-based instructions to perform one or more of the steps disclosed herein. The calculations service 579 may collect data, perform calculations, and/or provide key performance indicators. The calculations service may implement, for example, process dynamic modeling software or tools (e.g., UniSim).

Furthermore, the data analysis platform 504 may include a utility service 580. In some embodiments, the utility service 580 may comprise computer-executable instructions that, when executed by the processor, cause the data analysis platform 504 to perform one or more of the steps disclosed herein. In other embodiments, the utility service 580 may be a virtual machine. In some embodiments, the utility service 580 may be a hybrid of software-based and/or hardware-based instructions to perform one or more of the steps disclosed herein. The utility service 580 may take information from the calculations service and put the information into the data lake. The utility service 580 may provide data aggregation service, such as taking all data for a particular range, normalizing the data (e.g., determining an average), and combining the normalized data into a file to send to another system or module.

One or more components of the data analysis platform 504 may assist the processor 570 in the data analysis platform 504 in processing and analyzing the data values stored in the database. In some embodiments, the data analysis platform 504 may perform statistical analysis, predictive analytics, and/or machine learning on the data values in the database to generate predictions and models. For example, the data analysis platform 504 may analyze sensor data to detect new hot spots and/or to monitor existing hot spots (e.g., to determine if an existing hot spot is growing, maintaining the same size, or shrinking) in the equipment of a plant. The data analysis platform 504 may compare temperature data from different dates to determine if changes are occurring. Such comparisons may be made on a monthly, weekly, daily, hourly, real-time, or some other basis.

Referring to FIG. 5C, the data analysis platform 504 may generate recommendations for adjusting one or more parameters for the operation of the plant environment depicted in FIG. 5A. In some embodiments, the data analysis platform 504 may, based on the recommendations, generate command codes that may be transmitted, via the communications interface, to cause adjustments or halting/starting of one or more operations in the plant environment. The command codes may be transmitted to a control platform for processing and/or execution. In an alternative embodiment, the command codes may be directly communicated, either wirelessly or in a wired fashion, to physical components at the plant, where the physical components comprise an interface to receive the commands and execute them.

Although the elements of FIG. 5C are illustrated as logical block diagrams, the disclosure is not so limited. In particular, one or more of the logical boxes in FIG. 5C may be combined into a single logical box or the functionality performed by a single logical box may be divided across multiple existing or new logical boxes. Moreover, some logical boxes that are visually presented as being inside of another logical box may be moved such that they are partially or completely residing outside of that logical box. For example, while the database is visually depicted in FIG. 5C as being stored inside one or more memories 572 in the data analysis platform 504, FIG. 5C contemplates that the database may be stored in a standalone data store communicatively coupled to the processor of the data analysis platform via the communications interface of the data analysis platform 504. Furthermore, the databases from multiple plant locations may be shared and holistically analyzed to identify one or more trends and/or patterns in the operation and behavior of the plant and/or plant equipment. In such a crowdsourcing-type example, a distributed database arrangement may be provided where a logical database may simply serve as an interface through which multiple, separate databases may be accessed. As such, a computer with predictive analytic capabilities may access the logical database to analyze, recommend, and/or predict the behavior of one or more aspects of plants and/or equipment. In another example, the data values from a database from each plant may be combined and/or collated into a single database where predictive analytic engines may perform calculations and prediction models.

Referring to FIG. 5D, in one example, a control platform 506 may comprise a processor 584, one or more memories 586, and communication interfaces 592. The memory 586 may comprise a database 588 for storing data records of various values transmitted from a user interface, computing device, or other platform. The values may comprise parameter values for particular equipment at the plant. For example, some illustrative equipment at the plant that may be configured and/or controlled by the control platform include, but is not limited to, a feed switcher 541, sprayer 545, one or more valves 542, one or more pumps 540, one or more gates 543, and/or one or more drains. In addition, a control module 590 may be stored in the memory 586 and assist the processor 584 in the control platform 506 in receiving, storing, and transmitting the data values stored in the database 588. In some embodiments, the control module 590 may comprise computer-executable instructions that, when executed by the processor, cause the control platform 506 to perform one or more of the steps disclosed herein. In other embodiments, the control module 590 may be a hybrid of software-based and/or hardware-based instructions to perform one or more of the steps disclosed herein.

In a plant environment such as illustrated in FIG. 5A, if sensor data is outside of a safe range, this may be cause for immediate danger. As such, there may be a real-time component to the system such that the system processes and responds in a timely manner. Although in some embodiments, data could be collected and leisurely analyzed over a lengthy period of months, numerous embodiments contemplate a real-time or near real-time responsiveness in analyzing and generating alerts, such as those generated or received by the alert module in FIG. 5E.

Referring to FIG. 5E, in one example, a remote device 518 may comprise a processor 593, one or more memories 594, and communication interfaces 599. The memory 594 may comprise a database 595 for storing data records of various values entered by a user or received through the communications interface 599. In addition, an alert module 596, command module 597, and/or dashboard module 598 may be stored in the memory 594 and assist the processor 593 in the remote device 518 in processing and analyzing the data values stored in the database 595. In some embodiments, the aforementioned modules may comprise computer-executable instructions that, when executed by the processor 593, cause the remote device 518 to perform one or more of the steps disclosed herein. In other embodiments, the aforementioned modules may be a hybrid of software-based and/or hardware-based instructions to perform one or more of the steps disclosed herein. In some embodiments, the aforementioned modules may generate alerts based on values received through the communications interface. The values may indicate a dangerous condition or even merely a warning condition due to odd sensor readings. The command module 597 in the remote device 518 may generate a command that when transmitted through the communications interface 599 to the platforms at the plant, causes adjusting of one or more parameter operations of the plant environment depicted in FIG. 5A. In some embodiments, the dashboard module 599 may display a graphical user interface to a user of the remote device 518 to enable the user to view plant operating information and/or enter desired parameters and/or commands. These parameters/commands may be transmitted to the command module 597 to generate the appropriate resulting command codes that may be then transmitted, via the communications interface 599, to cause adjustments or halting/starting of one or more operations in the plant environment. The command codes may be transmitted to a control platform 506 for processing and/or execution. In an alternative embodiment, the command codes may be directly communicated, either wirelessly or in a wired fashion, to physical components at the plant such that the physical components comprise an interface to receive the commands and execute them.

Although FIG. 5E is not so limited, in some embodiments the remote device 518 may comprise a desktop computer, a smartphone, a wireless device, a tablet computer, a laptop computer, and/or the like. The remote device 518 may be physically located locally or remotely, and may be connected by one of communications links to the public network that is linked via a communications link to the private network 514. The network used to connect the remote device may be any suitable computer network including the Internet, an intranet, a wide-area network (WAN), a local-area network (LAN), a wireless network, a digital subscriber line (DSL) network, a frame relay network, an asynchronous transfer mode (ATM) network, a virtual private network (VPN), or any combination of any of the same. Communications links may be any communications links suitable for communicating between workstations and server, such as network links, dial-up links, wireless links, hard-wired links, as well as network types developed in the future, and the like. Various protocols such as transmission control protocol/Internet protocol (TCP/IP), Ethernet, file transfer protocol (FTP), hypertext transfer protocol (HTTP) and the like may be used, and the system can be operated in a client-server configuration to permit a user to retrieve web pages from a web-based server. Any of various conventional web browsers can be used to display and manipulate data on web pages.

Although the elements of FIG. 5E are illustrated as logical block diagrams, the disclosure is not so limited. In particular, one or more of the logical boxes in FIG. 5E may be combined into a single logical box or the functionality performed by a single logical box may be divided across multiple existing or new logical boxes. Moreover, some logical boxes that are visually presented as being inside of another logical box may be moved such that they are partially or completely residing outside of that logical box. For example, while the database is visually depicted in FIG. 5E as being stored inside one or more memories in the remote device 518, FIG. 5E contemplates that the database may be stored in a standalone data store communicatively coupled, via the communications interface 599, to the modules stored at the remote device 518 and processor 593 of the remote device 518.

Referring to FIG. 5, in some examples, the performance of operation in a plant may be improved by using a cloud computing infrastructure and associated methods, as described in U.S. Patent Application Publication No. 2016/0260041, which was published Sep. 8, 2016, and which is herein incorporated by reference in its entirety. The methods may include, in some examples, obtaining plant operation information from the plant and/or generating a plant process model using the plant operation information. The method may include receiving plant operation information over the Internet, or other computer network (including those described herein) and automatically generating a plant process model using the plant operation information. These plant process models may be configured and used to monitor, predict, and/or optimize performance of individual process units, operating blocks and/or complete processing systems. Routine and frequent analysis of predicted versus actual performance may further allow early identification of operational discrepancies which may be acted upon to optimize impact.

The aforementioned cloud computing infrastructure may use a data collection platform 502 (such as process scout) associated with a plant to capture data, e.g., sensor measurements, which are automatically sent to the cloud infrastructure, which may be remotely located, where it is reviewed to, for example, eliminate errors and biases, and used to calculate and report performance results. The data collection platform 502 may include an optimization unit that acquires data from a customer site, other site, and/or plant (e.g., sensors and other data collectors at a plant) on a recurring basis. For cleansing, the data may be analyzed for completeness and corrected for gross errors by the optimization unit. The data may also be corrected for measurement issues (e.g., an accuracy problem for establishing a simulation steady state) and overall mass balance closure to generate a duplicate set of reconciled plant data. The corrected data may be used as an input to a simulation process, in which the process model is tuned to ensure that the simulation process matches the reconciled plant data. An output of the reconciled plant data may be used to generate predicted data using a collection of virtual process model objects as a unit of process design.

The performance of the plant and/or individual process units of the plant may be compared to the performance predicted by one or more process models to identify any operating differences or gaps. Furthermore, the process models and collected data (e.g., plant operation information) may be used to run optimization routines that converge on an optimal plant operation for a given values of, e.g., feed, products, and/or prices. A routine may be understood to refer to a sequence of computer programs or instructions for performing a particular task.

The data analysis platform 504 may comprise an analysis unit that determines operating status, based on at least one of a kinetic model, a parametric model, an analytical tool, and a related knowledge and best practice standard. The analysis unit may receive historical and/or current performance data from one or a plurality of plants to proactively predict future actions to be performed. To predict various limits of a particular process and stay within the acceptable range of limits, the analysis unit may determine target operational parameters of a final product based on actual current and/or historical operational parameters. This evaluation by the analysis unit may be used to proactively predict future actions to be performed. In another example, the analysis unit may establish a boundary or threshold of an operating parameter of the plant based on at least one of an existing limit and an operation condition. In yet another example, the analysis unit may establish a relationship between at least two operational parameters related to a specific process for the operation of the plant. Finally in yet another example, one or more of the aforementioned examples may be performed with or without a combination of the other examples.

The plant process model may predict plant performance that is expected based upon plant operation information. The plant process model results can be used to monitor the health of the plant and to determine whether any upset or poor measurement occurred. The plant process model may be generated by an iterative process that models at various plant constraints to determine the desired plant process model.

Using a web-based system for implementing the method of this disclosure provides many benefits, such as improved plant economic performance due to an increased ability by plant operators to identify and capture economic opportunities, a sustained ability to bridge plant performance gaps, and an increased ability to leverage personnel expertise and improve training and development. Some of the methods disclosed herein allow for automated daily evaluation of process performance, thereby increasing the frequency of performance review with less time and effort required from plant operations staff.

Further, the analytics unit may be partially or fully automated. In one embodiment, the system is performed by a computer system, such as a third-party computer system, remote from the plant and/or the plant planning center. The system may receive signals and parameters via the communication network, and displays in real time related performance information on an interactive display device accessible to an operator or user. The web-based platform allows all users to work with the same information, thereby creating a collaborative environment for sharing best practices or for troubleshooting. The method further provides more accurate prediction and optimization results due to fully configured models. Routine automated evaluation of plant planning and operation models allows timely plant model tuning to reduce or eliminate gaps between plant models and the actual plant performance. Implementing the aforementioned methods using the web-based platform also allows for monitoring and updating multiple sites, thereby better enabling facility planners to propose realistic optimal targets.

Figure 6A:
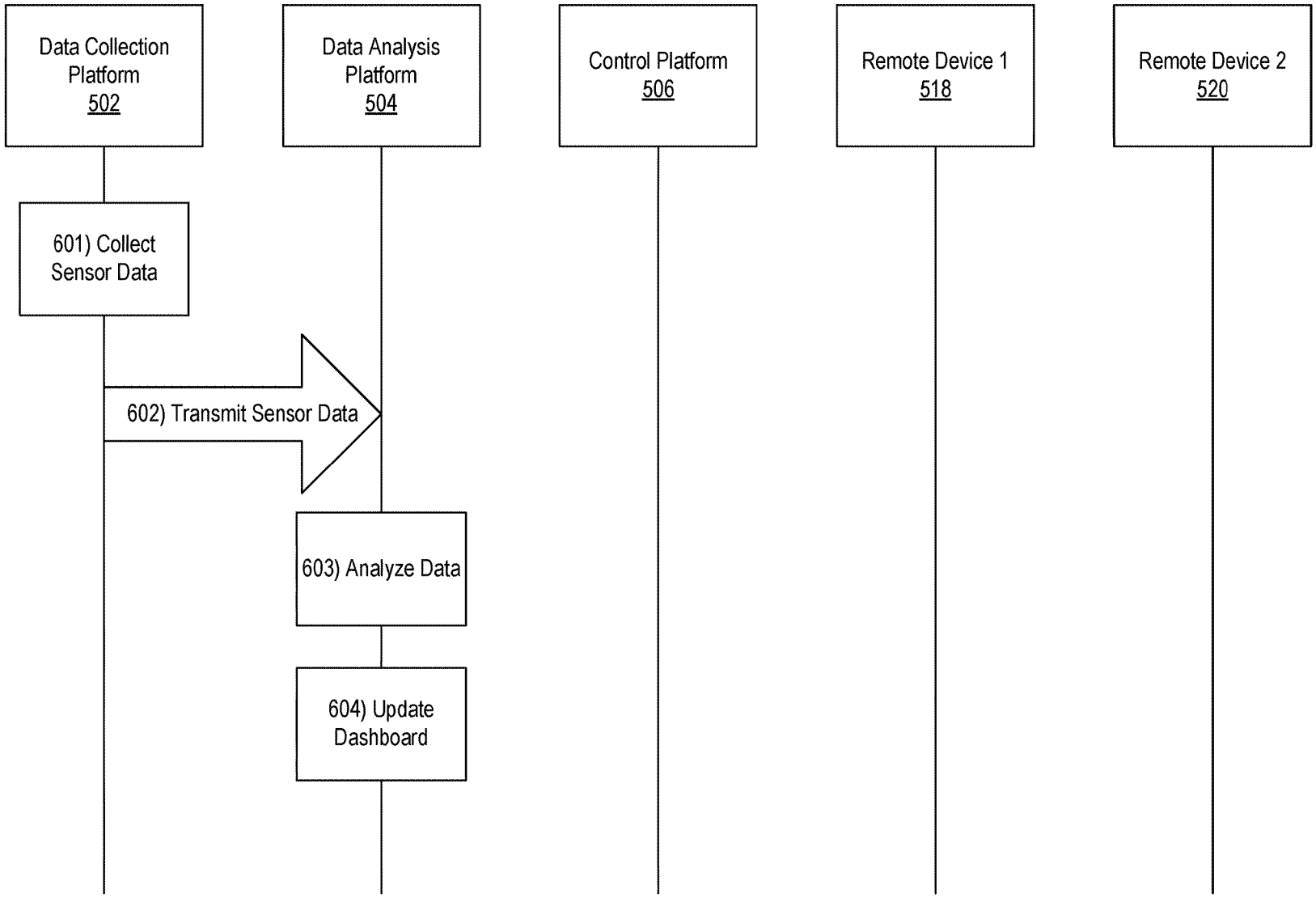
FIGS. 6A-6B depict an illustrative flow diagram of one or more steps that one or more devices may perform in controlling one or more aspects of a plant operation in accordance with one or more example embodiments.
Figure 6B:
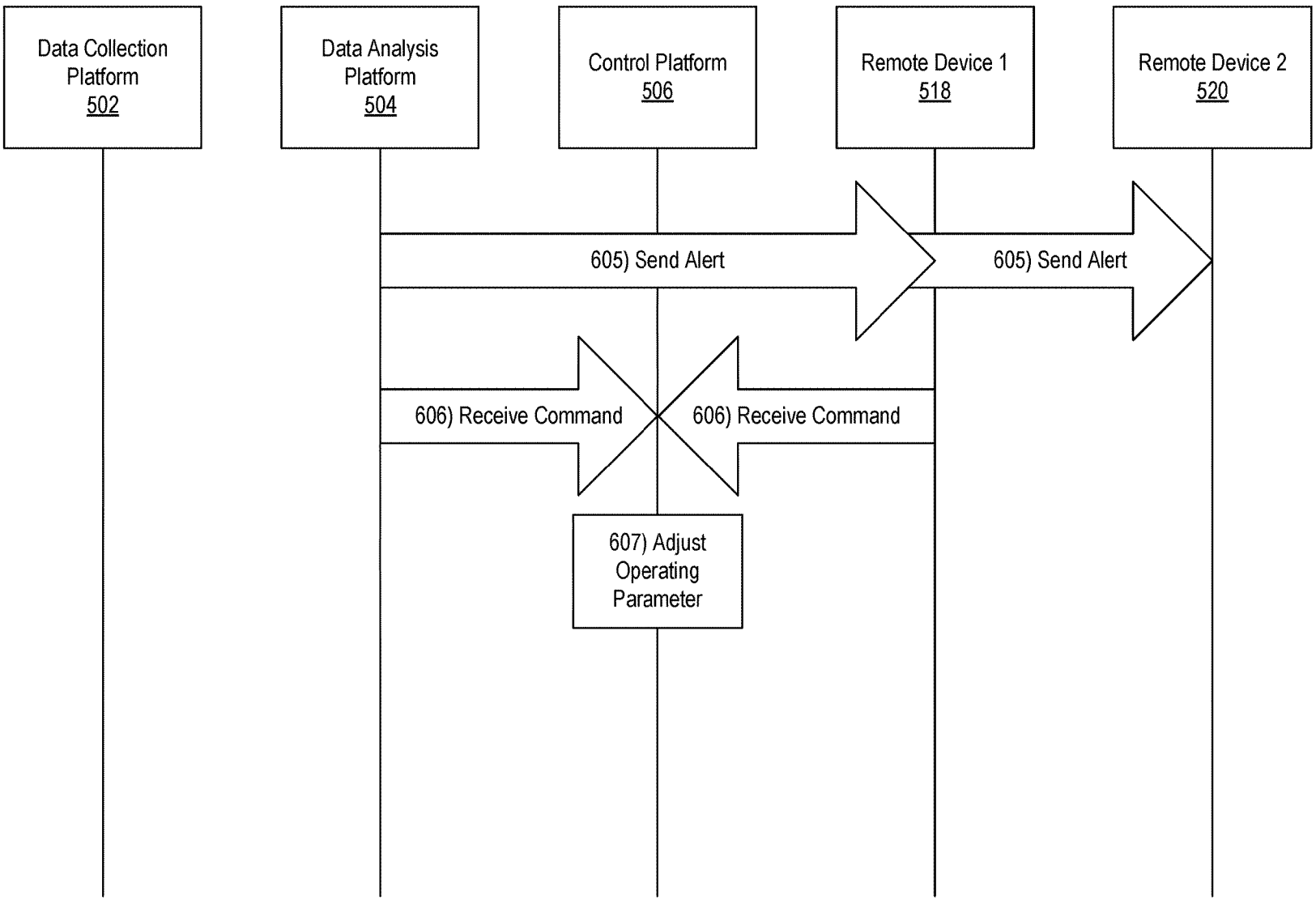

FIGS. 6A-6B depict illustrative system flow diagrams in accordance with one or more embodiments described herein. As shown in FIG. 6A, in step 601, data collection platform 502 may collect sensor data. In step 602, data collection platform 502 may transmit sensor data to data analysis platform 502. In step 603, data analysis platform 502 may analyze the received data. In one or more embodiments, the received data may be analyzed in conjunction with historical data from the plant from which the received data was collected, data from other plants different from the plant from which the received data was collected, simulation data, or the like. In step 604, data analysis platform 502 may update one or more dashboards.

As shown in FIG. 6B, in step 605, data analysis platform 504 may send an alert to first remote device 518 and/or second remote device 520. In step 606, data analysis platform 504 may receive a command from data analysis platform 504, first remote device 518, and/or second remote device 520. In some embodiments, control platform 506 may receive the command from first remote device 518, and/or second remote device 520. In step 207, data analysis platform 504 may send a command to control platform 506. In some embodiments, the command may be similar to the command received from first remote device 518 and/or second remote device 520. In some embodiments, data analysis platform 504 may perform additional analysis based on the received command from first remote device 518 and/or second remote device 520 before sending a command to control platform 506. In step 208, control platform 506 may adjust an operating parameter. The adjusting the operating parameter may be based on the command received from data analysis platform 504, first remote device 518, and/or second remote device 520. The adjusting the operating parameter may be related to one or more pieces of equipment (e.g., fired heater) associated with sensors that collected the sensor data in step 601. For example, a flow rate may be automatically increased or decreased, a valve may be automatically opened or closed, a process may be automatically started, stopped, extended, or shortened, or the like.

Detecting and Addressing Problems with Fired Heaters

Aspects of the present disclosure are directed to monitoring fired heater processes for potential and existing issues, providing alerts, and/or adjusting operating conditions to optimize burner life. There are many process performance indicators that may be monitored including, but not limited to, fuel, air (oxygen), emissions (e.g., CO, NOx), temperature, and/or pressure.

In some embodiments, a system may determine operating characteristics. The system may determine system performance characteristics. The system may determine optimal operating characteristics. In some embodiments, the optimal operating characteristics may be based on a designed-for operating level, a regulation (e.g., a maximum allowable emission level), or one or more other criteria. The system may determine whether there is a difference between recent operating performance and the optimal operating performance. If there is a difference (e.g., if the difference is above a threshold), the system may suggest adjusting one or more operating characteristics to decrease the difference between the actual operating performance in the recent and the optimal operating performance.

In some embodiments, the system may automatically adjust the one or more operating characteristics. Alternatively or additionally, the system may provide an alert or other information to an operator, with a request to adjust the one or more operating characteristics. In one example the system may adjust the flow of fuel gas, excess air to the heater, process flow, stack pressure, or the like. Adjusting the operating characteristics may be performed in an iterative fashion.

Periodically, the system may determine whether there is a difference between the actual operating performance and the optimal performance, and if so, again adjust operating characteristics to decrease the difference. By iteratively reviewing recent performance and adjusting characteristics, the system may thereby optimize the operating performance for a fired heater unit. This may result in improved performance, e.g., extend burner life, reduce energy use, reduce emissions.

Processing Sensor Data

One or more calculations may be performed for fired heater remote monitoring service. These calculations may assist in alerting and helping diagnose the status of burners and other components used in fired heaters.

The data processing platform may receive (e.g., from one or more sensors) one or more operational parameters, which may be used alone or in combination for determining the efficiency of the fired heater.

The data processing platform may use one or more design parameters, alone or in combination, for determining the status of the fired heater. A design parameter may be a level at which the fired heater was designed to operate at, below, or above. For example, a fired heater may be designed to emit less than a threshold level of a particular matter (e.g., based on a regulation controlling emissions of that matter).

In some instances, the timestamp of a calculated attribute may match the timestamp of the raw data used for the calculation. In some instances, a calculated attribute may use one or more results of one or more other calculated attributes; therefore, the order in which the attributes are calculated may be relevant.

In some embodiments, raw values may be checked for bad values. If bad values are detected, the data processing platform may either skip calculation or replace the bad value with NULL, as appropriate for subsequent calculations. For averages, a provision may be made to skip bad/null values and/or timestamps.

Some units of measurement for variables may be specified. Some variables may be dimensionless, and therefore might not have a defined unit of measurement.

Dashboard

Figure 7A:
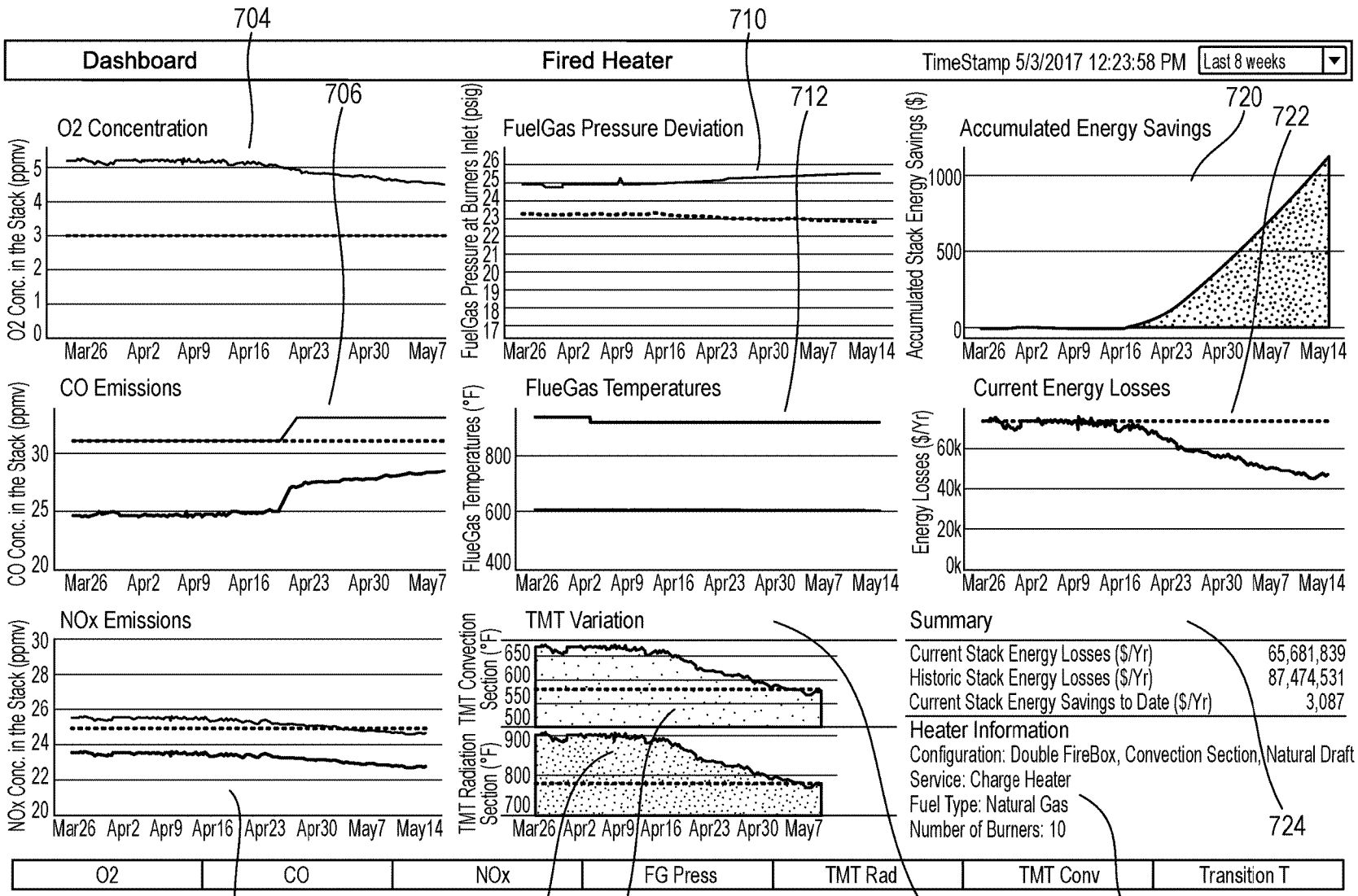
FIGS. 7A-7B depict illustrative dashboards for viewing information and/or taking actions related to one or more aspects of a plant operation in accordance with one or more example embodiments.
Figure 7B:
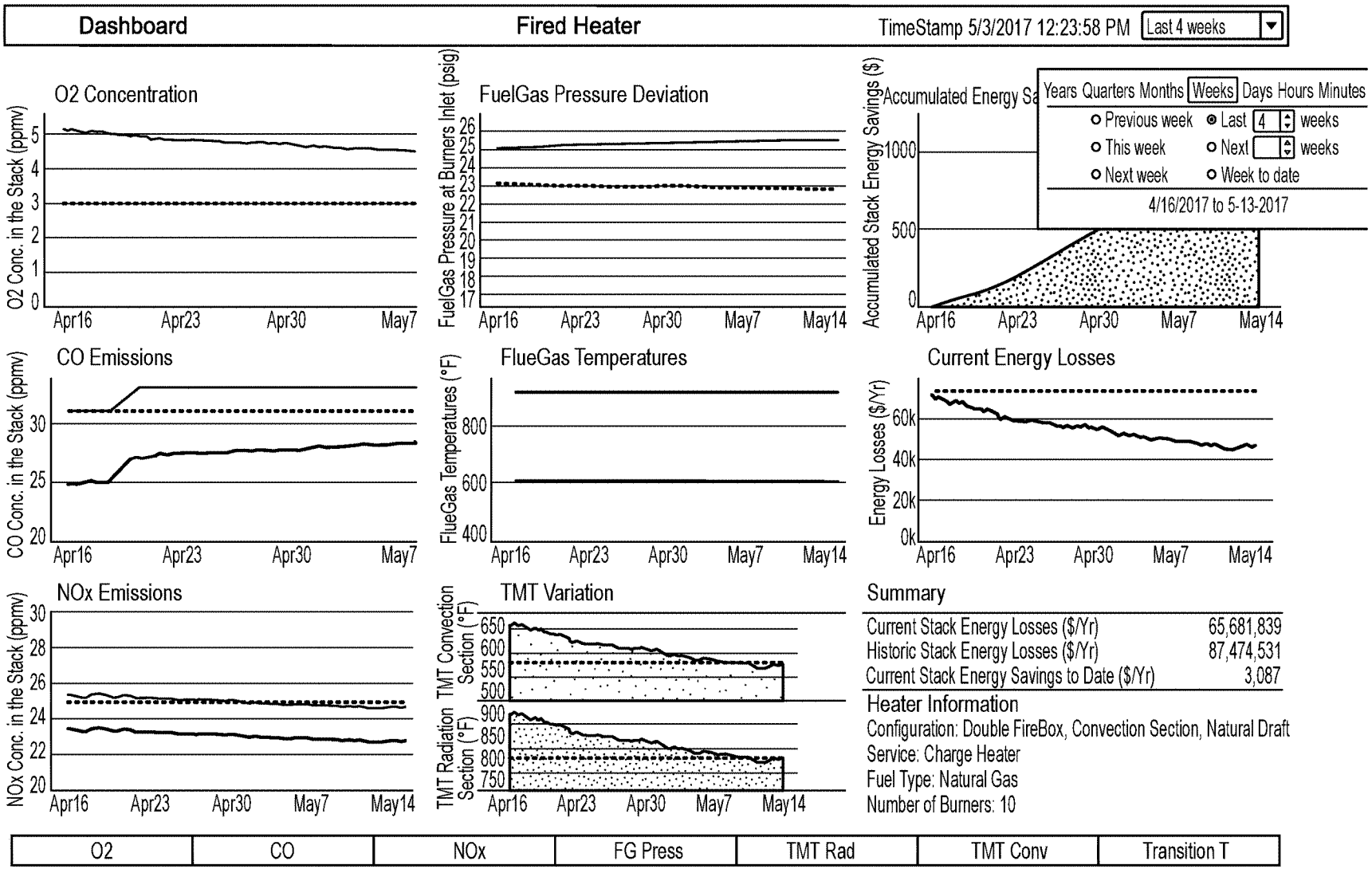

FIGS. 7A-7B depict an illustrative dashboard (e.g., dashboard 700) that may include information about the operation of a fired heater in accordance with one or more aspects described herein. The dashboard 700 may include or be a part of one or more graphical user interfaces of one or more applications that may provide information received from one or more sensors or determined based on analyzing information received from one or more sensors, according to one or more embodiments described herein. The dashboard 700 may be displayed as part of a smartphone application (e.g., running on a remote device, such as remote device 1 or remote device 2), a desktop application, a web application (e.g., that runs in a web browser), a web site, an application running on a plant computer, or the like.

The dashboard 700 may be different based on an intended user of the dashboard 700. For example, as depicted in FIG. 5A, one or more systems (e.g., the data analysis platform 504, the client portal 508) may interface with a dashboard. The data analysis platform dashboard 512 may be provide the same or different information, charts, graphs, buttons, functions, etc., than the client portal dashboard 510.

Returning to FIG. 7A, the dashboard 700 may include one or more visual representations of data (e.g., chart, graph) that shows information about a plant, a particular piece of equipment in a plant, or a process performed by a plant or a particular piece or combination of equipment in the plant. For example, a graph may show information about a gas concentration level, an emissions level, a temperature, a pressure, an operating condition, an efficiency, a production level, or the like. The dashboard 700 may include a description of the equipment, the combination of equipment, or the plant to which the visual display of information pertains.

The dashboard 700 may display the information for a particular time or period of time (e.g., the last five minutes, the last ten minutes, the last hour, the last two hours, the last 12 hours, the last 24 hours, multiple days, multiple months). The dashboard 700 may be adjustable to show different ranges of time, automatically or based on user input.

The dashboard 700 may include a contact name and/or contact information (e.g., telephone number, pager number, email address, text message number, social media account name) for a sales representative. Then, for example, if a dashboard user needs assistance (e.g., purchasing more burners, seeking assistance for repairs, finding out more information about purchased products), the dashboard user may easily contact the sales representative.

The dashboard 700 may include a contact name and/or contact information for technical support. Then, for example, if the dashboard user using the dashboard needs assistance (e.g., interpreting dashboard data, adjusting a product level, adjusting an equipment setting, adjusting an operating characteristic), the dashboard user may easily contact technical support.

The dashboard 700 may display a time and/or date range of the time and/or date range for which data is being displayed. For example, FIG. 7A depicts a period of eight weeks. FIG. 7B illustrates one method for changing the time period (e.g., to four weeks). Specifically, a pop-up window 730 may be triggered (e.g., by selecting an interface option, such as a drop-down arrow). The pop-up window 730 may allow selection of a time period (e.g., years, quarters, months, weeks, days, hours, minutes) for displaying data. The pop-up window 730 may allow selection of a range of data for a selected time (e.g., previous week, this week, next week, last x number of weeks, next x number of weeks, week to date).

Returning to FIG. 7A, the dashboard 700 may include, on one or more graphs, a line indicating an optimum operating level. Specifically, the line may indicate, based on one or more calculations, an optimum level at which a particular fired heater unit should be operated (e.g., relative to a particular operating characteristic) to achieve an optimization goal. The optimum operating level may be dynamic, based on a re-calculation of an optimum operating level using one or more operational and/or design characteristics. In an example, the optimization goal may be to optimize a life of the fired heater unit, burner unit, convection or radiant tubes, or the like. In a specific example, on a graph of $O_2$ concentration, the line indicating the optimum operating level may indicate an optimum amount of $O_2$ in the stack (e.g., 3%). In another example, the line indicating the optimum operating level may indicate a regulated limit of CO or NOx that a particular fired heater unit may emit.

The dashboard 700 may include, on one or more graphs, a line indicating a design level. Specifically, the line may indicate the level at which the equipment was designed to operate. The design line may be static. The design line may be based on an actual operating condition of another factor. For example, the design line for emission levels of a first matter may be based on the actual operating level of a second matter. Thus, for example, if the $O_2$ concentration is at a first level, the design line for CO emissions may be at a first level, and if the $O_2$ concentration is at a second level, the design line for CO emissions may be at a second level. The design line may be provided by, e.g., an entity associated with a design of the equipment, the plant, or the like.

The dashboard 700 may include, on one or more graphs, a line, bar, or other indicator of an actual operating result. The actual operating result may be related to a time and/or date range (e.g., the displayed time and/or date range). The actual operating result may be related to a particular fired heater unit (e.g., dark blue for a first fired heater unit, medium blue for a second fired heater unit, light blue for a third fired heater unit). The actual operating result may be dynamic.

The dashboard 700 may include one or more colored banners (e.g., at the bottom of the dashboard) that may correspond to one or more current operating conditions corresponding to one or more graphs of the dashboard. The colored banners may include one or more colors (e.g., green, yellow, red), which may correspond to one or more operating conditions of fired heater equipment. For example, if a gas concentration level of equipment is at an acceptable level, the colored banner may be green. If the gas concentration level of the equipment is at a level that necessitates increased monitoring or that may indicate an impending need (e.g., maintenance), the colored banner may be yellow. If the gas concentration level of the equipment is at a problematic level, the colored banner may be red.

The dashboard 700 may include a graph 704 that shows $O_2$ concentration in the stack over a time period (e.g., six weeks). The graph may include a first line that indicates an ideal or desired level, and a second line that indicates an actual operating level. The graph may correspond with a colored banner at the bottom of the screen. The banner may indicate if the $O_2$ level is within in a suitable range (e.g., green), an elevated but acceptable range (e.g., yellow), or is out of range (e.g., red).

The dashboard 700 may include a graph 706 that shows CO emissions in the stack over a time period (e.g., eight weeks). The graph may include a first line that indicates a maximum emission level (e.g., based on a regulation), and a second line that indicates an actual emission level. The graph may correspond with a colored banner at the bottom of the screen. The banner may indicate if the CO level is in a suitable range (e.g., green), an elevated but acceptable range (e.g., yellow), or is out of range (e.g., red).

The dashboard 700 may include a graph 708 that shows NOx concentration in the stack over a time period. The graph may include a first line that indicates a maximum emission level (e.g., based on a regulation), a second line that indicates an actual operating level, and a third line that indicates an emission level based on another factor (e.g., what the NOx emissions would be if the $O_2$ concentration was at the designed-for level (e.g., 3%)). The graph may correspond with a colored banner at the bottom of the dashboard. The banner may indicate if the NOx level is in a suitable range (e.g., green), an elevated but acceptable range (e.g., yellow), or is out of range (e.g., red).

The dashboard 700 may include a graph 710 that shows fuel gas pressure at the burner inlets over a time period. The graph may include a first line that indicates fuel gas pressure at an ideal condition (based on a number of different conditions, e.g., weather, feed composition), and a second line that indicates fuel gas pressure at current operating conditions. By seeing the two different lines on the same graph, a user may determine a deviation between the two lines. If the deviation changes, the user may determine that something has changed in the system, and may further determine that additional inspections and/or repairs need to be made. In some embodiments, the system may generate and/or send an alert to a local or remote device based on the deviation changing more than a threshold amount or passing above or below a particular threshold amount. The graph may correspond with a colored banner at the bottom of the dashboard. The banner may indicate if the fuel gas concentration is in a suitable range (e.g., green), an elevated but acceptable range (e.g., yellow), or is out of range (e.g., red).

The dashboard 700 may include a graph 712 that shows flue gas temperatures in the stack over a time period. The graph may include a first line that indicates a temperature at a first section (e.g., radiation section) of the fired heater, and a second line that indicates a temperature at a second section (e.g., convection section) of the fired heater. The graph may correspond with a colored banner at the bottom of the dashboard. The banner may indicate if the FuelGas temperature is in a suitable range (e.g., green), an elevated but acceptable range (e.g., yellow), or is out of range (e.g., red).

The dashboard 700 may include a display 714 of tube metal temperature (TMT) variation in the convection and radiation sections. The graph may include multiple charts; for example, a first chart 718 that shows TMT in a first section (e.g., radiation section) of the fired heater, and a second chart 716 that shows TMT in a second section (e.g., convection section) of the fired heater. Each chart may depict a daily average of a number of different temperature readings from within the corresponding section of the fired heater. For example, the temperature of the convection section of the fired heater may be measured hourly, and the 24 different temperature readings from the course of the day may be averaged to determine the average temperature for that day of the convection section of the fired heater. The graph may include a line that shows the designed-for average temperature for each section (e.g., convection, radiation) of the heater. The graph may also represent each tube metal temperature indication separately, allowing the user to look for hot spots within the heater box. Hot spots could be an indication of equipment degradation and future maintenance requirements. The graph may correspond with a colored banner at the bottom of the dashboard. The banner may indicate if the TMT radiation, TMT convection, and transition temperature are within suitable ranges (e.g., green), elevated but acceptable ranges (e.g., yellow), or are out of range (e.g., red).

In another example, a savings chart (e.g., accumulated energy savings chart) 720 may show an accumulated amount of energy savings, which may be a dynamically increasing total number of dollars that the operator saved by optimizing fired heater operating characteristics. For example, energy losses may be suffered by using more fuel than is necessary. Because the system makes more close monitoring possible, as well as corresponding repairs and adjustments to operating conditions, a fuel heater may be operated more efficiently, thereby producing energy savings.

In another example, a losses chart (e.g., accumulated energy losses chart) 722 may show current levels of energy losses (e.g., energy expended unnecessarily) over time. As energy losses are decreased (e.g., by operating the fired heater more efficiently), the energy savings (e.g., as depicted on the energy savings chart) may increase. The losses chart may include a line that shows a baseline amount of energy losses, which may correspond to a design level of energy usage, a historical average level of energy usage, or some other baseline against which to compare current energy losses.

In some embodiments, the dashboard 700 may include a summary 724 of current stack energy losses, historic stack energy losses, and current stack energy savings over a time period, e.g., yearly.

In some embodiments, the dashboard 700 may include heater information 726, such as the type of configuration, service, fuel type, and/or number of burners of a heater.

The dashboard 700 may be configured to receive a confirmation of whether one or more fired heater units are operating within healthy operating times. This may give the operator additional confidence and/or information about how to adjust one or more operating characteristics for the fired heater unit to optimize burner life while minimizing risk to the process outcomes. Alternatively or additionally, a control system may automatically adjust the one or more operating characteristics for the fired heater unit to optimize burner life while minimizing risk to the process outcomes.

In some aspects, data displayed by the dashboard 700 may be refreshed in real time, according to a preset schedule (e.g., every five seconds, every ten seconds, every minute), and/or in response to a refresh request received from a user.

The dashboard 700 may include a button or option that allows a user to send data to one or more other devices. For example, the user may be able to send data via email, SMS, text message, IMESSAGE, FTP, cloud sharing, AIRDROP, or some other method. The user may be able to select one or more pieces of data, graphics, charts, graphs, elements of the display, or the like to share or send.

The data collected by this system may provide a historical information of events, operations, and/or data. This information can be modelled to predict and/or anticipate future issues. This can be used to call for proactive maintenance actions and/or make corrective actions to the operation of the process unit to have an uninterrupted service.

Alerts

In some embodiments, a graphical user interface of an application may be used for providing alerts and/or receiving or generating commands for taking corrective action related to fired heater units, in accordance with one or more embodiments described herein. The graphical user interface may include an alert with information about a current state of a piece of equipment (e.g., a fired heater), a problem being experienced by a piece of equipment (e.g., a fired heater or burner), a problem with a plant, or the like. For example, the graphical user interface may include an alert that a fired heater is experiencing a particular issue, a fired heater is operating at a particular level, a particular problem has been detected, or another alert.

The graphical user interface may include one or more buttons that, when pressed, cause one or more actions to be taken. For example, the graphical user interface may include a button that, when pressed, causes an operating characteristic (e.g., of a fired heater unit, of a valve, of a plant, or the like) to change. For example, an amount of fuel being used may be increased or decreased (e.g., the computer may send a signal that opens or closes one or more valves or adjusts one or more flow controllers that control an amount of fuel provided to a fired heater) in response to a particular condition being detected. In another example, the graphical user interface may include a button that, when pressed, sends an alert to a contact, the alert including information similar to the information included in the alert provided via the graphical user interface. For example, an alert may be sent to one or more devices, and one or more users of those devices may cause those devices to send alerts, further information, and/or instructions to one or more other devices. In a further example, the graphical user interface may include a button that, when pressed, shows one or more other actions that may be taken (e.g., additional corrective actions, adjustments to operating conditions).

Several levels of alerts may be utilized. One level of alerts may be for alerts that require emergency action (e.g., Level 1). Another level of alerts may be for alerts that require action, but not immediate action (e.g., Level 2). Another level of alerts may be for alerts that are not related to the fired heater unit (e.g., Level 3). A number of illustrative alerts are described below. These alerts are merely illustrative, and the disclosure is not limited to these alerts. Instead, these are merely examples of some of the types of alerts that may be related to, e.g., a fired heater unit. As exemplified below, the alerts may identify the problem or issue and/or what corrective action (if any) may or should be taken.

An alert may include an indication of the alert level (e.g., level 1, level 2, level 3). The alert may include a name or identifier of the alert. The name or descriptive identifier of the alert may include a description of the determined problem that the alert is based on. The alert may include information on the determined problem. The alert may include information about potential causes of the determined problem. The alert may include a recommended further action (e.g., investigate and contact service representative). The alert may include information about who has received the alert. The alert may include an error code and/or error description for the error. The alert may include potential consequences of the error. The alert may include suggested actions for resolving the error.

Level 1 Alert: Burner not Operating.

The system has detected a major concern relating to burner #17. Please investigate and contact service representative. A copy of this alert has been sent to your service representative. Error: Burner inoperable.

Level 2 Alert: Burner Inefficiency.

The system has detected a concern relating to the burner #19. Please investigate and take corrective actions. A copy of this alert has been sent to your service representative. Error: Burner inefficiency. Suggested Actions: Investigate potential causes, and continue operation. May require burner replacement.

CONCLUSION

Aspects of the disclosure have been described in terms of illustrative embodiments thereof. Numerous other embodiments, modifications, and variations within the scope and spirit of the appended claims will occur to persons of ordinary skill in the art from a review of this disclosure. For example, one or more of the steps illustrated in the illustrative figures may be performed in other than the recited order, and one or more depicted steps may be optional in accordance with aspects of the disclosure.

What is claimed is:

1. Non-transitory computer-readable media storing executable instructions that, when executed by one or more processors, cause a system to:

receive sensor data comprising operating information for a fired heater unit of a plant at a first operating condition representing a current operating condition for an element of the fired heater unit;

receive sensor data comprising operating information for the fired heater unit of the plant at a second operating condition, the second operating condition determined using a predictive model, wherein the predictive model determines a relationship between energy consumption and operating parameters of the plant comprising fuel gas flow, fuel composition, excess air flow, and emissions of the plant;

analyze the sensor data comprising the operating information to determine at least a one of the operating parameters of the plant comprising the fuel gas flow input information for the plant, the excess air information for the plant, and the emissions information four the plant;

determine an adjustment to an operating parameter of the plant at the second operating condition which has a lower energy consumption compared with the first operating condition, wherein the determining is based on one or more of: the fuel input information for the plant, the air information for the plant, and the emissions information for the plant, and wherein the determining is performed with an iterative method based on the predictive model to determine the minimal energy consumption by adjusting the fuel flow and the air flow subject to emissions, pressure drop in the fired heater unit, process temperature and fired heater tube wall temperature constraints; and, transmit a command configured to cause the adjustment to the operating parameter of the plant.

2. The non-transitory computer-readable media of claim 1, wherein the executable instructions, when executed, cause the system to:

use one or more design parameter of the plant to determine a status of the fired heater unit of the plant, wherein the one or more design parameters comprise an operating condition at which the fired heater was designed to operate at, below, or above.

3. The non-transitory computer-readable media of claim 1, wherein the executable instructions, when executed, cause the system to:

check a raw value of the sensor data to determine whether the raw value of the sensor data comprises a bad value; and based on determining that the raw value of the sensor data comprises the bad value, replace the raw value of the sensor data comprising the bad value with null data.

4. The non-transitory computer-readable media of claim 1, wherein the executable instructions, when executed, cause the system to:

receive information about one or more of: a gas concentration level of the plant, an emissions level of the plant, a temperature of the plant, a pressure of the plant, an efficiency of the plant, or a production level of the plant; and, provide, via a dashboard, the received information about the one or more of a gas concentration level of the plant, an emissions level of the plant, a temperature of the plant, a pressure of the plant, an efficiency of the plant, or a production level of the plant.

5. The non-transitory computer-readable media of claim 1, wherein the executable instructions, when executed, cause the system to:

determine an optimum level at which the fired heater unit should be operated to achieve an optimization goal; and provide, via a dashboard, information regarding the optimum level at which the fired heater unit should be operated to achieve the optimization goal.

6. The non-transitory computer-readable media of claim 5, wherein the executable instructions, when executed, cause the system to:

use one or more operational characteristics of the fired heater unit or design characteristics of the fired heater unit to determine the optimum level at which the fired heater unit should be operated to achieve the optimization goal.

7. The non-transitory computer-readable media of claim 6, wherein the executable instructions, when executed, cause the system to:

receive information about an $O_2$ concentration in a stack of the fired heater unit of the plant; and, display, via the dashboard, a graph of the $O_2$ concentration in the stack of the fired heater unit of the plant.

* * * * *